US006329747B1

(12) United States Patent
Noguchi et al.

(10) Patent No.: US 6,329,747 B1
(45) Date of Patent: Dec. 11, 2001

(54) CATHODE RAY TUBE HAVING AN OVERALL LENGTH THEREOF SHORTENED

(75) Inventors: Kazunari Noguchi, Chiba; Shoji Shirai, Mobara; Tomoki Nakamura, Mobara; Yasuharu Yatsu, Mobara, all of (JP)

(73) Assignee: Hitachi, Ltd., Toyko (JP)

( * ) Notice: Subject to any disclaimer, the term of this patent is extended or adjusted under 35 U.S.C. 154(b) by 0 days.

(21) Appl. No.: 09/478,342

(22) Filed: Jan. 6, 2000

(30) Foreign Application Priority Data

Jan. 7, 1999 (JP) ..... 11-002064

(51) Int. Cl.[7] ..... H01J 29/50
(52) U.S. Cl. ..... 313/414; 313/412; 313/460
(58) Field of Search ..... 313/412, 414, 313/415, 416, 446, 456, 460

(56) References Cited

U.S. PATENT DOCUMENTS 5,917,275 * 6/1999 Uchida et al. ..... 313/412 X
5,942,844 * 8/1999 Nakamura et al. ..... 313/414

FOREIGN PATENT DOCUMENTS 1-102836 4/1989 (JP) .
5-2999 1/1993 (JP) .
6-36705 2/1994 (JP) .
6-36708 2/1994 (JP) .
7-211255 8/1995 (JP) .
7-220650 8/1995 (JP) .
8-83575 3/1996 (JP) .
8-190877 7/1996 (JP) .
8-315750 11/1996 (JP) .
9-171780 6/1997 (JP) .
9-171781 6/1997 (JP) .
10-116572 5/1998 (JP) .
10-289673 10/1998 (JP) .

* cited by examiner

*Primary Examiner*—Ashok Patel
(74) *Attorney, Agent, or Firm*—Antonelli, Terry, Stout & Kraus, LLP

(57) ABSTRACT

The in-line type electron gun includes an electron beam generating section for generating and directing plural electron beams along toward a phosphor screen, and an electron beam focusing section for focusing the plural electron beams from the electron beam generating section onto the phosphor screen. The electron beam focusing section includes a focus electrode, at least one intermediate electrode and an anode supplied with a highest voltage arranged in the order named. The at least one intermediate electrode is supplied with an intermediate voltage between the highest voltage and a voltage supplied to the focus electrode. The following relationship is satisfied: $1.55 \leqq D/L \leqq 1.72$, and $18.2\ \text{mm} \leqq d \leqq 26\ \text{mm}$, where D (mm) is a diagonal length of a usable display area of the phosphor screen, L (mm) is a distance from a center of the phosphor screen to an end of the anode facing toward the focus electrode, and d (mm) is an outside diameter of the neck portion.

8 Claims, 26 Drawing Sheets

CATHODE RAY TUBE HAVING AN OVERALL LENGTH THEREOF SHORTENED

BACKGROUND OF THE INVENTION

The present invention relates to a cathode ray tube, and particularly to a cathode ray tube having its overall length shortened with its deflection angle increased, but without increasing deflection power consumption or degrading display resolution.

Cathode ray tubes such as color cathode ray tubes used as TV picture tubes and monitor tubes for information terminals house an electron gun for emitting a plurality (usually three) of electron beams at one end of an evacuated envelope, a phosphor screen (a viewing screen) formed of phosphors coated on an inner surface of the evacuated envelope at the other end thereof for emitting light of a plurality (usually three) of colors, and a shadow mask which serves as a color selection electrode and is closely spaced from the phosphor screen.

The electron beams emitted from the electron gun are deflected to scan the phosphor screen horizontally and vertically in two dimensions, by magnetic fields generated by a deflection yoke mounted externally of the evacuated envelope and display a desired image on the phosphor screen.

FIG. 16 is a schematic cross-sectional view of a shadow mask type color cathode ray tube as an example of a cathode ray tube to which the present invention is applicable, and FIG. 17 is a front view of a panel portion of the color cathode ray tube of FIG. 16.

In FIG. 16, reference numeral 1 denotes the panel portion forming a viewing screen, 2 is a neck portion, 3 is a funnel portion, 4 is a phosphor screen, 5 is a shadow mask, 6 is a mask frame, 7 is a magnetic shield, 8 is a mask suspension mechanism, 9 is an in-line type electron gun, 10 is a deflection yoke, 11 is an internal conductive coating, 12 is a shield cup, 13 is a contact spring, 14 is a getter, 15 is a stem, 16 are stem pins, 17 is an implosion protection band, 18 is a magnetic beam adjusting device, and 19 is a usable display area.

In FIG. 16, a dimension L is a distance from the phosphor screen 4 to the end of the anode on the focus electrode side thereof, of the in-line beam type electron gun 9, and a dimension d is an outside diameter of the neck portion 2. In FIG. 17, a dimension D is a diagonal length of the usable display area 19.

The evacuated envelope of this color cathode ray tube is comprised of the panel portion 1, the neck portion 2 and the funnel portion 3. Three electron beams (one center electron beam Bc and two side electron beams Bs) emitted from the in-line type electron gun housed in the neck portion 2 is scanned over the phosphor screen 4 two-dimensionally by the horizontal and vertical deflection magnetic fields generated by the deflection yoke 10 mounted around the transition region between the funnel portion 3 and the neck portion.

The highest voltage (an anode voltage) to the electron gun is supplied by the contact springs 13 attached to the shield cup 12 via the internal conductive coating 11 coated on the inner surface of the funnel portion 3 from an anode button (not shown) embedded in a wall of the funnel portion 3.

The deflection yoke 10 is of a self-converging type which provides a pin cushion-like horizontal deflection magnetic field and a barrel-like vertical deflection magnetic field to converge a plurality of electron beams over the entire phosphor screen.

The electron beams Bc, Bs are modulated in amount by modulating signals such as video signals supplied via the stem pins 1 6, are color-selected by the shadow mask 5 disposed immediately in front of the phosphor screen 4, and impinge upon the phosphors of the corresponding colors to reproduce a desired image. Color purity of the reproduced color image and static convergence of the three electron beams are adjusted by the magnetic beam adjusting device 18 mounted around the neck portion 2.

In color cathode ray tubes of this type, a large-diameter non-axially-symmetric lens formed between an anode and a focus electrode are extensively used as a main lens system of the electron gun to provide sufficiently small electron beam spots over the entire phosphor screen.

FIG. 18 is a schematic side elevation view of a prior art electron gun employing the large-diameter non-axially-symmetric lens system viewed in a direction perpendicular to the in-line direction of the electron beams. In this electron gun, an electron beam generating section is comprised of a cathode 21, the first grid electrode 22 and the second grid electrode 23, and an accelerating and focusing section is comprised of the third grid electrode 24 serving as a focus electrode and the fourth electrode 25 serving as an anode. The cathode and electrodes are fixed on a pair of insulating rods 26 made of glass in the predetermined order and the predetermined spaced relationship.

The contact springs 13 are attached to the front end of the shield cup 12 which in turn is attached to the anode 25. The highest voltage is applied to the anode 15 by the resilient contact springs 13 pressed against the internal conductive coating 11 on the inner wall of the funnel portion 3.

FIG. 19 is a plan view of the third grid electrode 24 viewed from an anode side thereof and FIG. 20 is a cross-sectional side view of the third grid electrode 24 viewed in a direction perpendicular to the in-line direction of the three electron beams. Reference 31 denotes an electric field correction plate having three vertically elongated electron beam apertures with their minor diameters in the in-line direction of the electron beams and disposed within the third grid electrode 24, and reference numeral 32 denotes an electrode having the configuration of the outer periphery of a racetrack shape (hereinafter referred to as a racetrack electrode) and formed with a single opening with its major diameter in the in-line direction of the electron beams.

FIG. 21 is a plan view of the anode 25 viewed from the third grid electrode 24 side thereof and FIG. 22 is a cross-sectional side view of the anode 25 viewed in the direction perpendicular to the in-line direction of the three electron beams. Reference 33 denotes an electric field correction plate having a vertically elongated electron beam aperture at the center with its minor diameter in the in-line direction of the electron beams and cutouts on opposite sides of the electron beam aperture and disposed within the anode 25, and reference numeral 34 denotes a racetrack electrode formed with a single opening with its major diameter in the in-line direction of the electron beams. With such an electrode structure, an effectively large-diameter electron lens is formed between the grid electrode 24 and the anode to provide a high definition image display.

SUMMARY OF THE INVENTION

While cathode ray tubes presently used as a monitor tube in the information terminals increases in the size of the viewing screen, there is a demand for reduction of their overall length with a view to improving the efficiency of utilization of the space.

The overall length of cathode ray tubes without changing the size of the viewing screen can be shortened by increasing the maximum deflection angle of the electron beams so as to decrease the distance from the phosphor screen to the end of the anode on its focus electrode (the third grid electrode).

In this specification, the ratio D/L is used instead of a deflection angle, where D (mm) is a diagonal length of the usable display area of the viewing screen, and L (mm) is a distance from the center of the phosphor screen to the end of the anode on its focus electrode side in a cathode ray tube.

A 90° deflection angle is extensively employed in presently-used monitor tubes for information terminals and this corresponds to the D/L of about 1.35. If the ratio D/L is increased without changing the overall length of an electron gun, the overall length of the cathode ray tube decreases correspondingly.

If the ratio is selected to be at least 1.55, for example, the overall length of a cathode ray tube having the D of 460 mm (corresponding to a nominal 19-inch diagonal tube) is shortened approximately to that of a cathode ray tube having the D of 410 mm (corresponding to a nominal 17-inch diagonal tube) with D/L being 1.35, and the overall length of a cathode ray tube having the D of 510 mm (corresponding to a nominal 21-inch diagonal tube) is shortened approximately to that of a cathode ray tube having the D of 460 mm (corresponding to a nominal 19-inch diagonal tube) with D/L being 1.35.

But, if the ratio D/L is selected to be at least 1.55 for the prior art cathode ray tubes, the deflection power consumption is increased due to the increase beam deflection angle when the outside diameter of a glass tube forming the neck portion (hereinafter referred to as a glass neck tube) is unchanged, and is 29.1 mm, for example, as in the prior art cathode ray tubes.

FIG. 23 is a graph showing the relationship between the deflection power consumption ($MHA^2$) and the outside diameter d (mm) of the glass neck tubes with the ratio D/L as a parameter, where D (mm) is a diagonal length of the usable display area of the viewing screen, and L (mm) is a distance from the center of the phosphor screen to the end of the anode on its focus electrode side in cathode ray tubes. In this specification, for simplicity, the deflection power consumption is evaluated in terms of a product of an inductance (mH) of a deflection yoke and the square of a peak-to-peak value of a deflection current (A). The curves (a) and (b) correspond to the D/L of 1.35 (a 90° deflection) and 1.55 (a 100° deflection) and the curve (c) indicates the case of the D/L of 2.25 (a 110° deflection) for comparison.

FIG. 23 shows that the deflection power consumption of the cathode ray tube with the D/L of 1.55 increases by about 17% compared with that of the cathode ray tube with the D/L of 1.35 when both the cathode ray tubes use a glass neck tube of 29.1 mm in outside diameter.

The increase in deflection power consumption increases load to the deflection circuit, and consequently the increase in the deflection power consumption needs to be limited to about 10% at most, that is, the deflection power consumption needs to be limited to 17.4 $mHA^2$ at most, so that the cathode ray tubes with the higher D/L ratio are operated at a high deflection frequency comparable to that operable with the prior art cathode ray tubes with the D/L of 1.35. This means that the outside diameter of the glass neck tube needs to be 26 mm at most.

The wall thickness of the glass neck tube generally needs to be about 2.5 mm to prevent destruction of the glass neck tube by arcing and consequently reduction of the outside diameter of the glass neck tube results in the reduction of the inside diameter of the glass neck tube which in turn reduces the outside diameter of the electron gun housed in the glass neck tube.

FIG. 24 is a graph showing the relationship between the outside diameter of the glass neck tubes and the effective lens diameter of the main lenses formed by the electrodes shown in FIGS. 19 to 22. In this specification, the effective lens diameter of a lens is defined as a diameter of an equal-diameter two-cylinder lens having aberration approximately equal to that of the lens in question. It shows that the outside diameter 29.1 mm of the glass neck tube provides the effective lens diameter of 8 mm, but the outside diameter 24.3 mm of the glass neck tube provides the effective lens diameter of 5.6 mm, resulting in the reduction of about 30% in the effective lens diameter.

This reduction in the effective lens diameter increases spherical aberration, consequently increases the diameter of the electron beam spots and degrades the quality of the displayed images. This has been an obstacle to employing the larger beam deflection angles.

The diameter of an electron beam in the main lens has to be optimized to reduce the diameter of the beam spot on the phosphor screen. An analysis by computer simulation showed that the optimum electron beam diameter in the main lens is about 1.3 mm for a main lens of 8 mm in diameter and this minimizes the electron beam spot on the phosphor screen.

FIG. 25 is a schematic cross-sectional view of the neck portion for explaining the minimum usable outside diameter of the glass neck tube, reference character N denotes the glass neck tube, M is an electrode of the main lens and A are electron beam apertures in the electrode M of the main lens. In FIG. 25, for simplicity we have omitted a number of features needed for the electrode of the main lens.

The electrode M of the main lens is housed in the glass neck tube N of d (mm) in outside diameter. The diameter d1 of each of electron beam apertures A in the electrode M must be at least 1.3 mm so that the electron beams do not strike the electrode M.

When the electrode M (the electric field correction plate 31 in FIG. 19, for example) of the main lens is made of a plate-like component, the thickness of the plate-like component must be at least 0.5 mm in order to provide sufficient mechanical strength, and a spacing S2 between the opposing edges of the two adjacent electron beam apertures A must be at least 0.5 mm to facilitate punching of the electron beam apertures A by using a punch press.

FIG. 26 is a graph showing the relationship between the displacement P of the electron beam spot on the phosphor screen caused by charging of the inner surface of the glass neck tube after the cathode ray tube operation of 24 hours and the distance S1 from the center line of a path of the side electron beam to the inner wall of the glass neck tube.

It is known that the maximum permissible displacement P of the electron beam spot on the phosphor screen after the operation of 24 hours is generally 0.1 mm, and therefore FIG. 26 shows that the displacement P of the electron beam spot after the operation of 24 hours is kept within the maximum permissible limit by selecting the distance S1 to be at least 4.8 mm.

The minimum of the outside diameter d of the glass neck tube N is calculated with the wall thickness S3 of the glass neck tube being 2.5 mm as follows:

$$d=2\times(S1+S2+d1+S3)=2\times(4.8+0.5+1.3+2.5)=18.2 \text{ mm.}$$

The minimum usable outside diameter d of the glass neck tube N is 18.2 mm.

FIG. 27 is a graph showing the relationship between deflection power consumption and the ratio D/L of a diagonal length D of the usable display area of the viewing screen to a distance L from the center of the phosphor screen to the end of the anode on its focus electrode side in a cathode ray tube for the outside diameters of the glass neck tubes of 18.2 mm and 29.1 mm. The curve (a) indicates the relationship for the glass neck tube of 18.2 mm in outside diameter and the curve (b) indicates the relationship for the glass neck tube of 29.1 mm in outside diameter for comparison.

The curve (a) shows that the ratio D/L must be selected to be not more than 1.72 to limit the deflection power consumption to 17.4 $mHA^2$. But it has been difficult to shorten the overall length of a cathode ray tube without increasing deflection power consumption or degrading the image quality.

It is an object of the present invention to provide a cathode ray tube having its overall length shortened without increasing deflection power consumption or degrading the image quality, by solving the above problems.

The following describes the representative structures of the cathode ray tubes in accordance with present invention for achieving the above object.

To accomplish the above objects, in accordance with an embodiment of the present invention, there is provided a color cathode ray tube comprising an evacuated envelope comprising a panel portion, a neck portion and a funnel portion for connecting said panel portion and said neck portion, a phosphor screen formed on an inner surface of said panel portion, an in-line type electron gun housed in said neck portion, and an electron beam deflection yoke mounted around a transition region between said funnel portion and said neck portion for generating magnetic deflection fields, said in-line type electron gun comprising an electron beam generating section having a plurality of in-line cathodes, an electron beam control electrode and an accelerating electrode arranged in the order named for generating and directing a plurality of electron beams along separate paths in a horizontal plane toward said phosphor screen, an electron beam focusing section for focusing said plurality of electron beams from said electron beam generating section onto said phosphor screen, said electron beam focusing section comprising a focus electrode, at least one intermediate electrode and an anode supplied with a highest voltage arranged in the order named, said at least one intermediate electrode being supplied with an intermediate voltage between said highest voltage and a voltage supplied to said focus electrode, wherein the following relationship is satisfied:

$$1.55 \leqq D/L \leqq 1.72,$$

and $$18.2 \text{ mm} \leqq d \leqq 26 \text{ mm},$$

where D (mm) is a diagonal length of a usable display area of said phosphor screen, L (mm) is a distance from a center of said phosphor screen to an end of said anode facing toward said focus electrode, and d (mm) is an outside diameter of said neck portion.

To accomplish the above objects, in accordance with another embodiment of the present invention, there is provided a color cathode ray tube wherein in the above embodiment, said focus electrode are subdivided into a plurality of electrode members, at least one first-type electron lens is formed by electrode members of said plurality of electrode members for focusing said plurality of electron beams in one of horizontal and vertical directions and diffusing said plurality of electron beams in another of the horizontal and vertical directions, a strength of said at least one first type electron lens becoming weaker with increasing deflection of said plurality of electron beams, a second-type electron lens is formed by electrode members of said plurality of electrode members for exerting a focusing action on said plurality of electron beams weakening with the increasing deflection of said plurality of electron beams, and a main lens is formed by said anode, said at least one intermediate electrode and one of said plurality of electrode members facing said at least one intermediate electrode for focusing said plurality of electron beams stronger in a horizontal direction than in a vertical direction.

The above embodiments provide cathode ray tubes having their overall length shortened without increasing the deflection power consumption or degrading the image display quality.

The present invention is not limited to the structure of the above embodiments, and various changes and modifications can be made to the above-explained structures without departing from the spirit and scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The present invention will now be described in detail with reference to the accompanying drawings.

Figure 1:
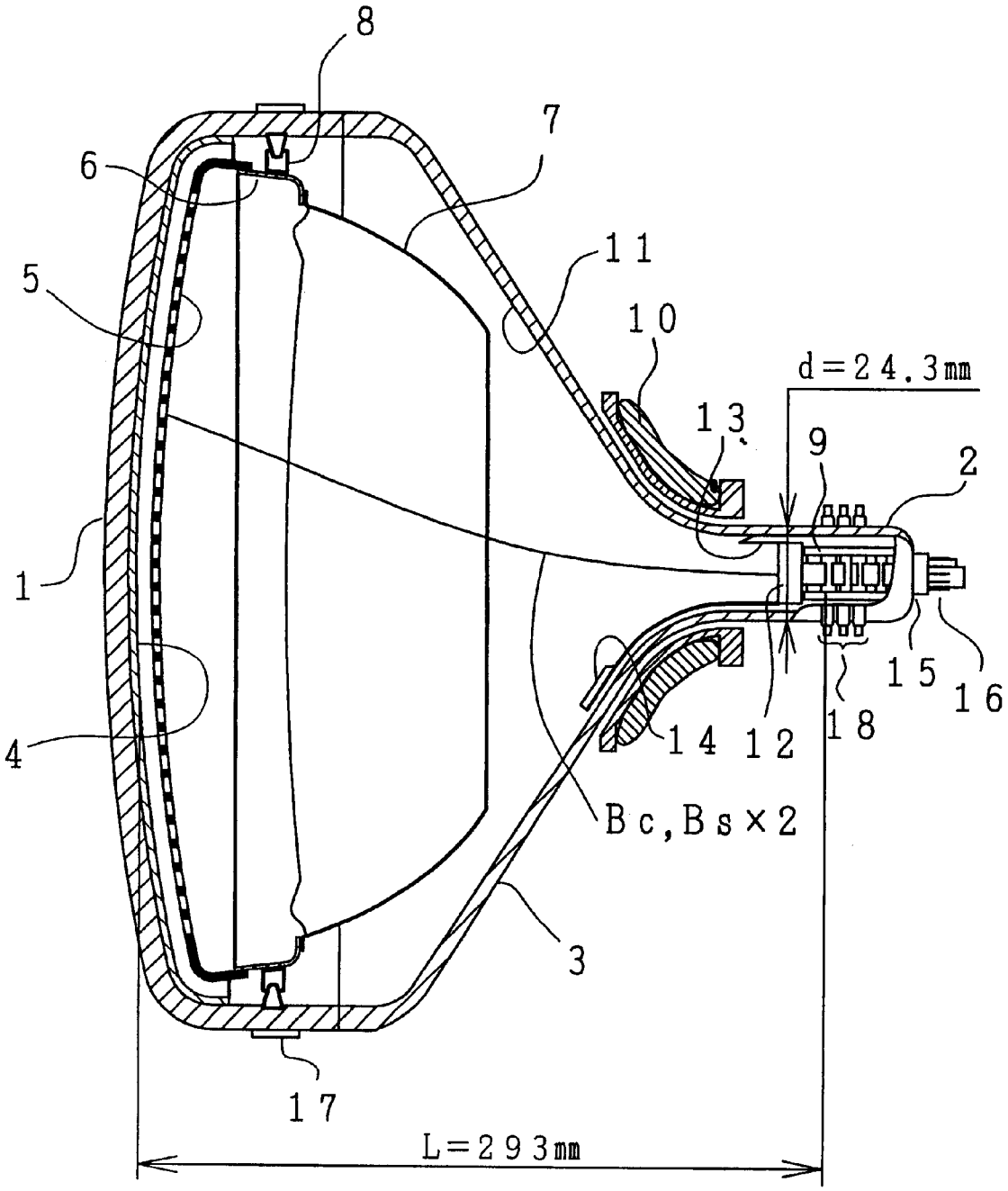
FIG. 1 is a schematic cross-sectional view of a shadow mask type color cathode ray tube similar to that shown in FIG. 16, for explaining an embodiment of a cathode ray tube in accordance with the present invention.
Figure 16:
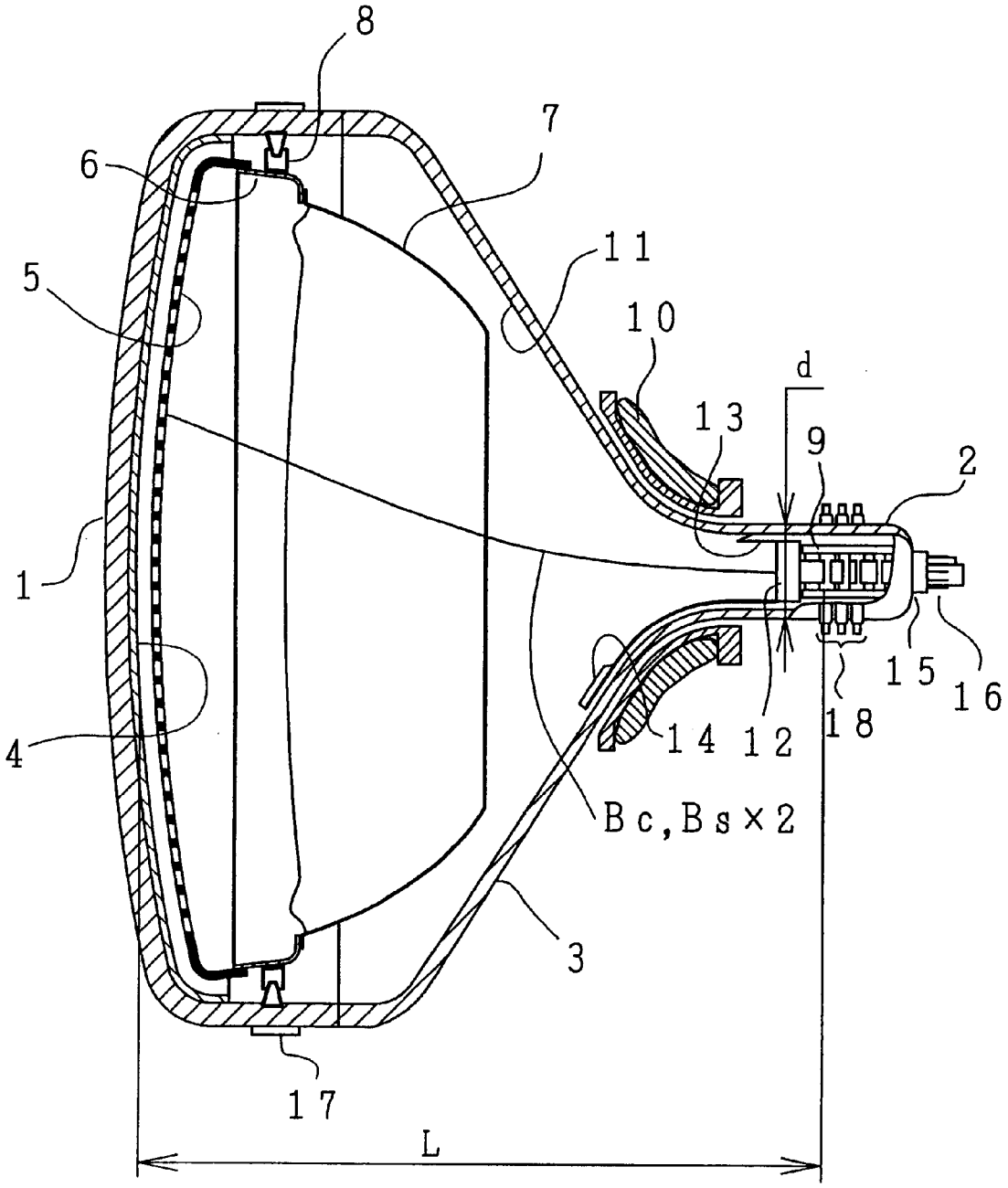
FIG. 16 is a schematic cross-sectional view of a shadow mask type color cathode ray tube as an example of a cathode ray tube to which the present invention is applicable.

FIG. 1 is a schematic cross-sectional view of a shadow mask type color cathode ray tube similar to that shown in FIG. 16, for explaining a first embodiment of a cathode ray tube in accordance with the present invention. The construction and operation of this color cathode ray tube is similar to those of the color cathode ray tube of FIG. 16, and therefore the explanation of those is omitted here.

Figure 17:
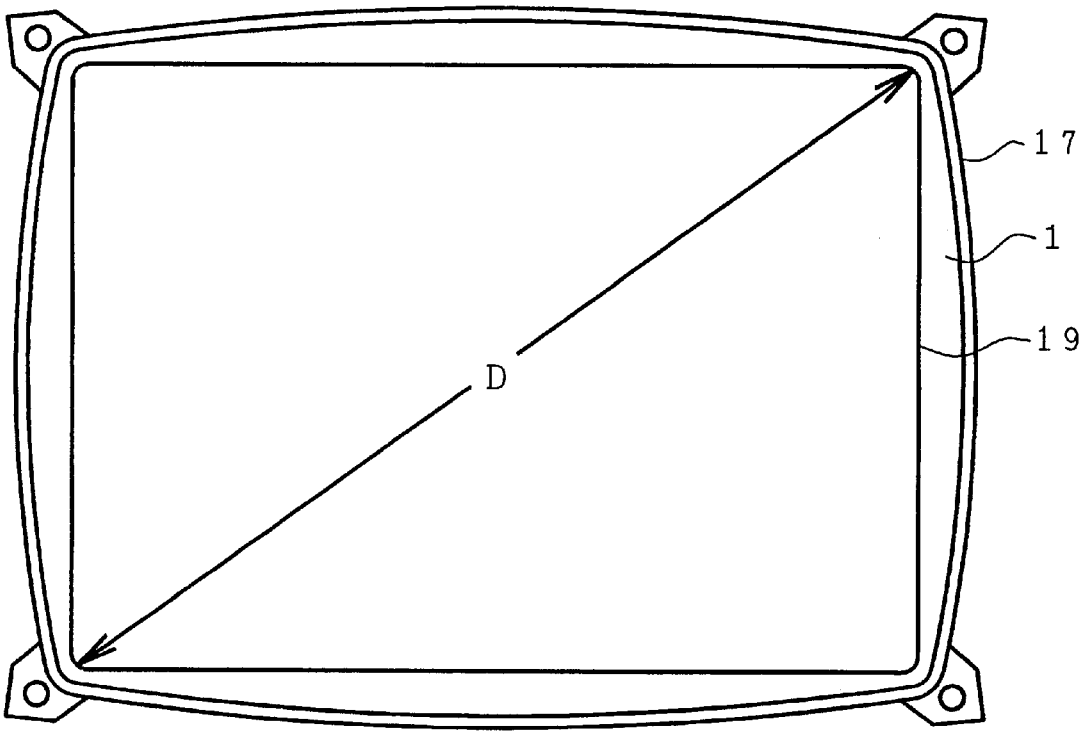
FIG. 17 is a front view of a panel portion of the color cathode ray tube of FIG. 16.

The diagonal length D of the usable display area of the viewing screen of the panel portion 1 in FIG. 17 is 460 mm in the case of FIG. 1, and the outside diameter d of the neck portion 2 is 24.3 mm.

Figure 2:
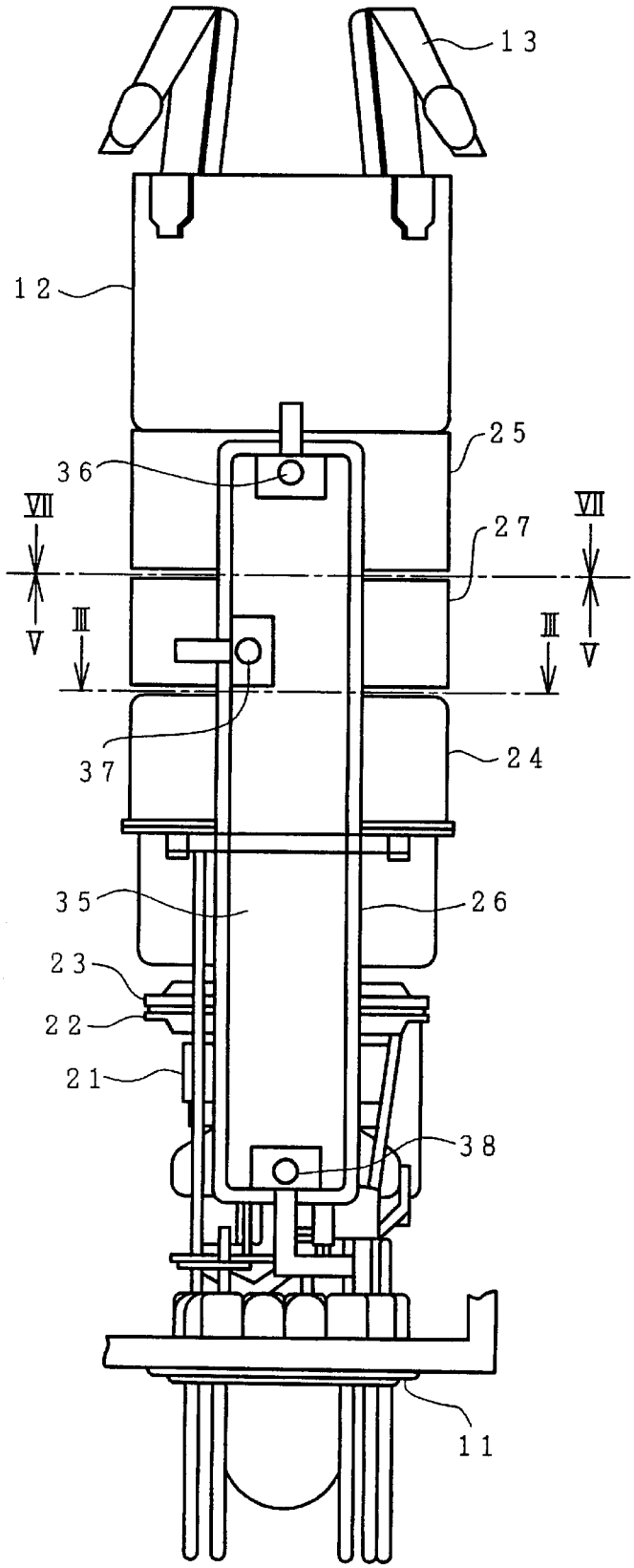
FIG. 2 is a schematic side elevation view of an in-line type electron gun housed in a neck portion of the color cathode ray tube of FIG. 1, viewed in a direction perpendicular to the in-line direction of the electron beams.
Figure 18:
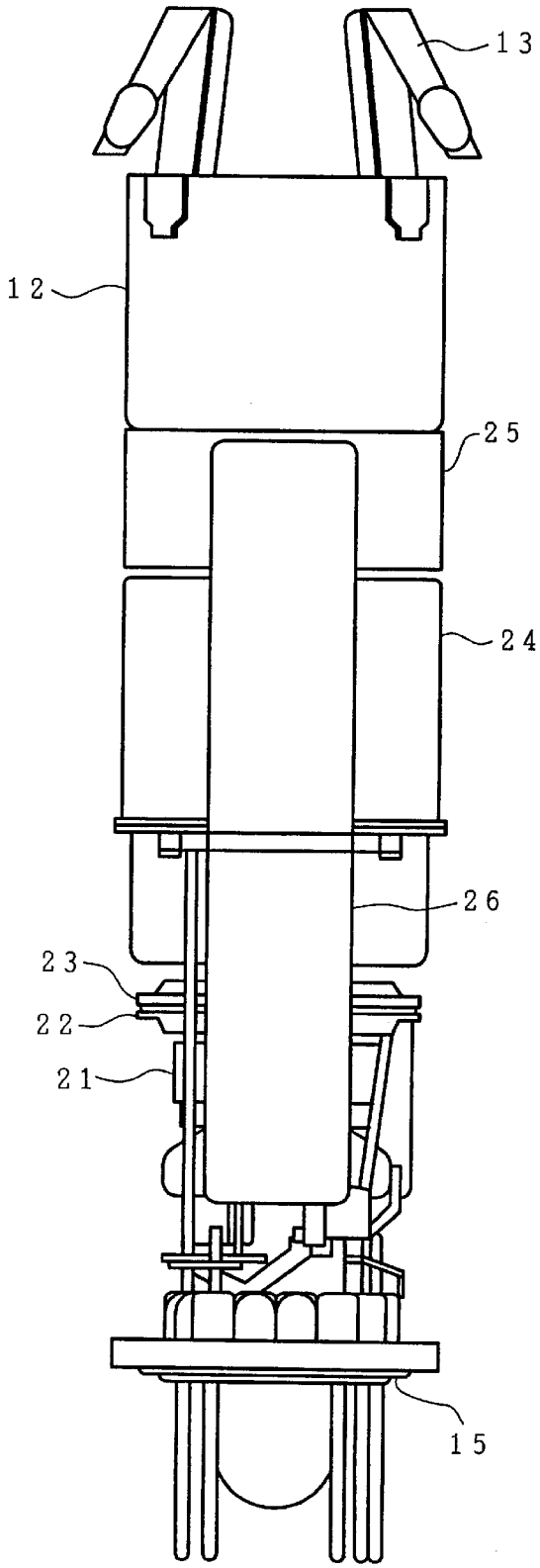
FIG. 18 (PRIOR ART)
FIG. 18 is a schematic side elevation view of a prior art electron gun employing a large-diameter non-axially symmetric lens system viewed in a direction perpendicular to the in-line direction of the electron beams.
Figure 19:
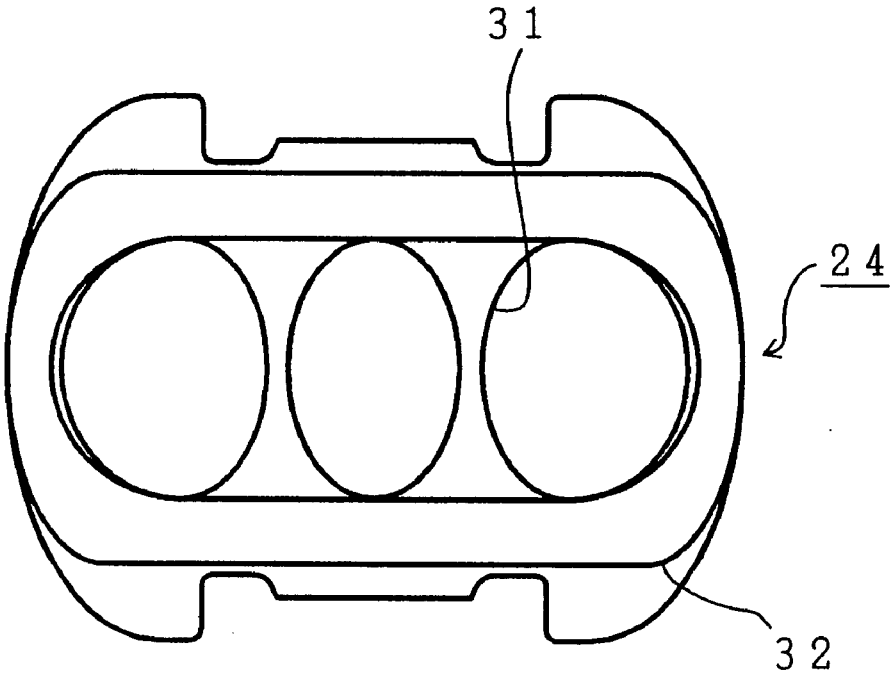
FIG. 19 is a plan view of the third grid electrode of the electron gun viewed from an anode side thereof of FIG. 18.
Figure 20:
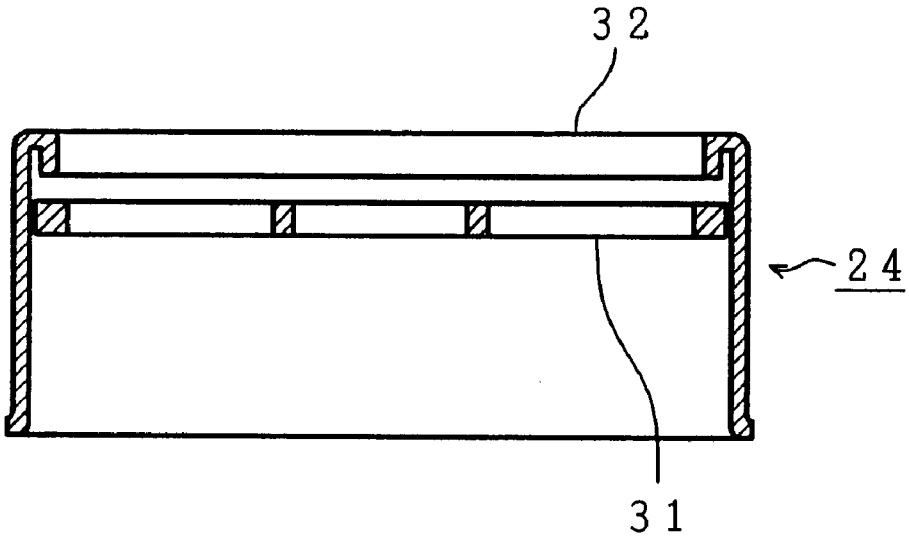
FIG. 20 is a cross-sectional view of the third grid electrode of the electron gun of FIG. 18 viewed in a direction perpendicular to the in-line direction of the three electron beams.
Figure 21:
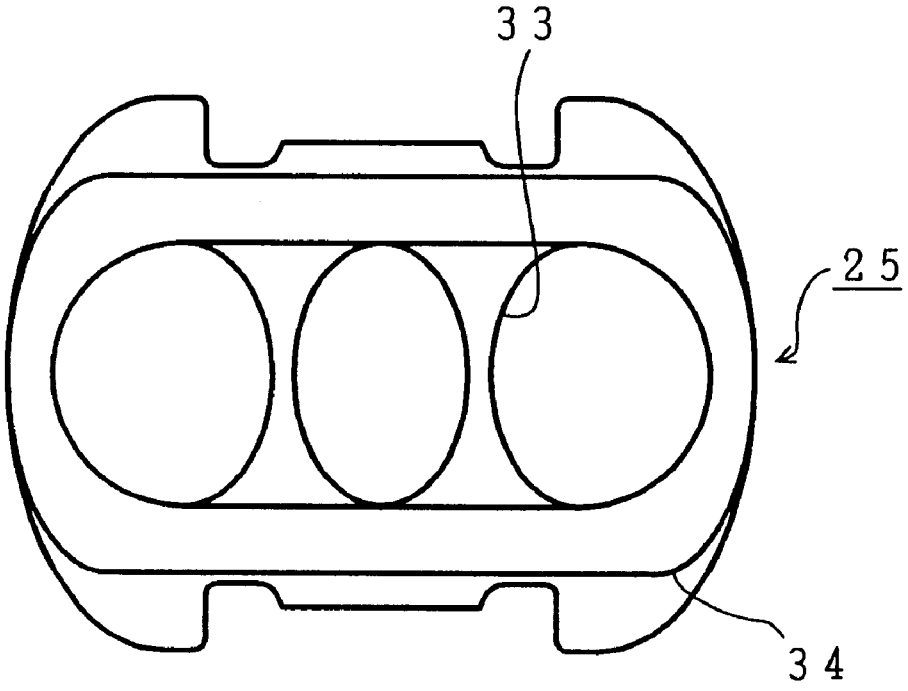
FIG. 21 is a plan view of the anode viewed from the third grid electrode side thereof.
Figure 22:
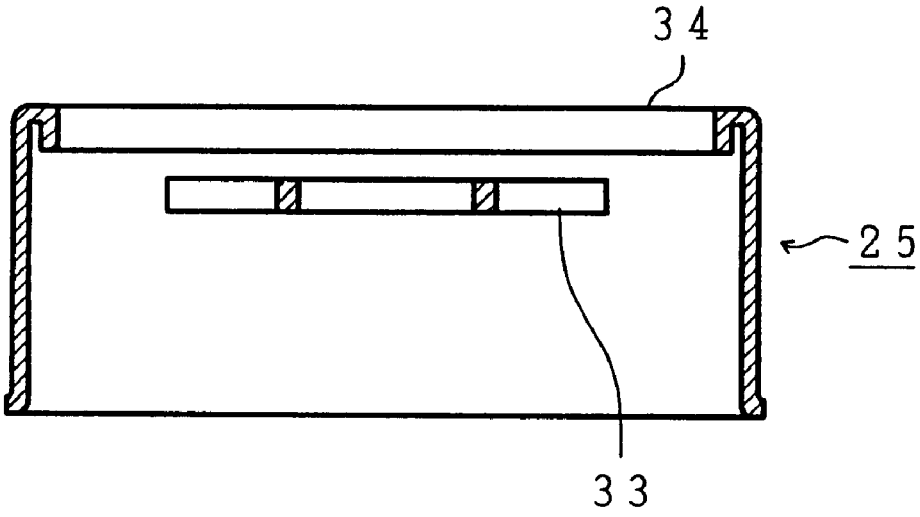
FIG. 22 is a cross-sectional view of the anode viewed in the direction perpendicular to the in-line direction of the three electron beams.

FIG. 2 is a schematic side elevation view of an in-line type electron gun housed in the neck portion of the color cathode ray tube of FIG. 1, viewed in a direction perpendicular to the in-line direction of the electron beams. This electron gun differs from the prior art electron gun shown in FIG. 18 in that an intermediate 27 electrode is disposed between the grid electrode 24 serving as a focus electrode and the fifth electrode 25 serving as an anode.

Further, this electron gun is provided with an internal resistor 35 attached to one of a pair of insulating support rods 26 for fixing the electrodes of the electron guns therebetween. The internal resistor 35 has an anode terminal 36 welded to a shield cup 12, an intermediate terminal 37 welded to the intermediate electrode 27 and a low voltage terminal 38 welded to a grounding terminal of the electron gun or the like.

Figure 3:
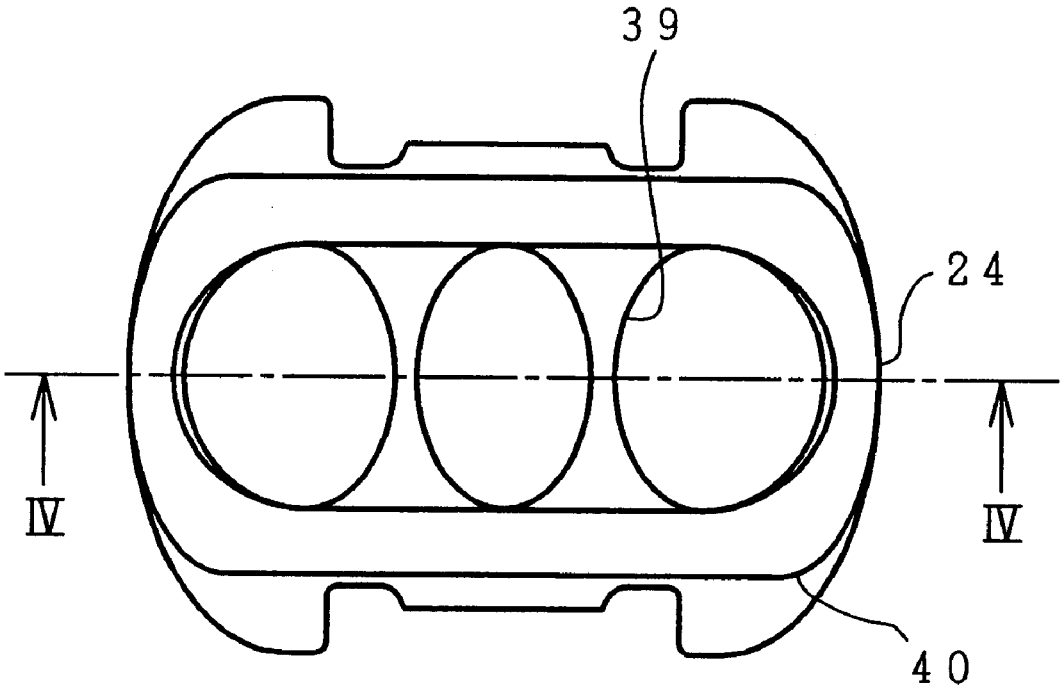
FIG. 3 is a plan view of the third grid electrode taken along line III—III of FIG. 2.
Figure 4:
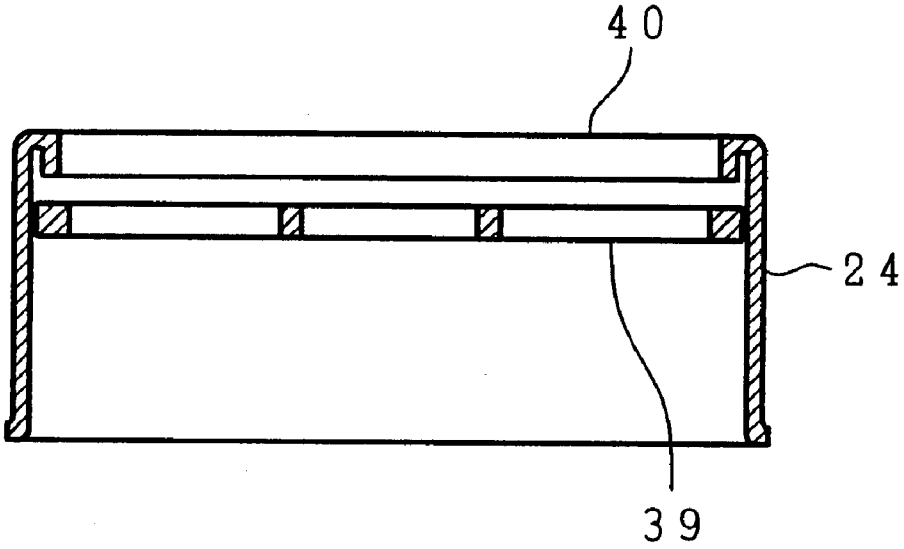
FIG. 4 is a cross-sectional view of the third grid electrode taken along line IV—IV of FIG. 3.
Figure 5:
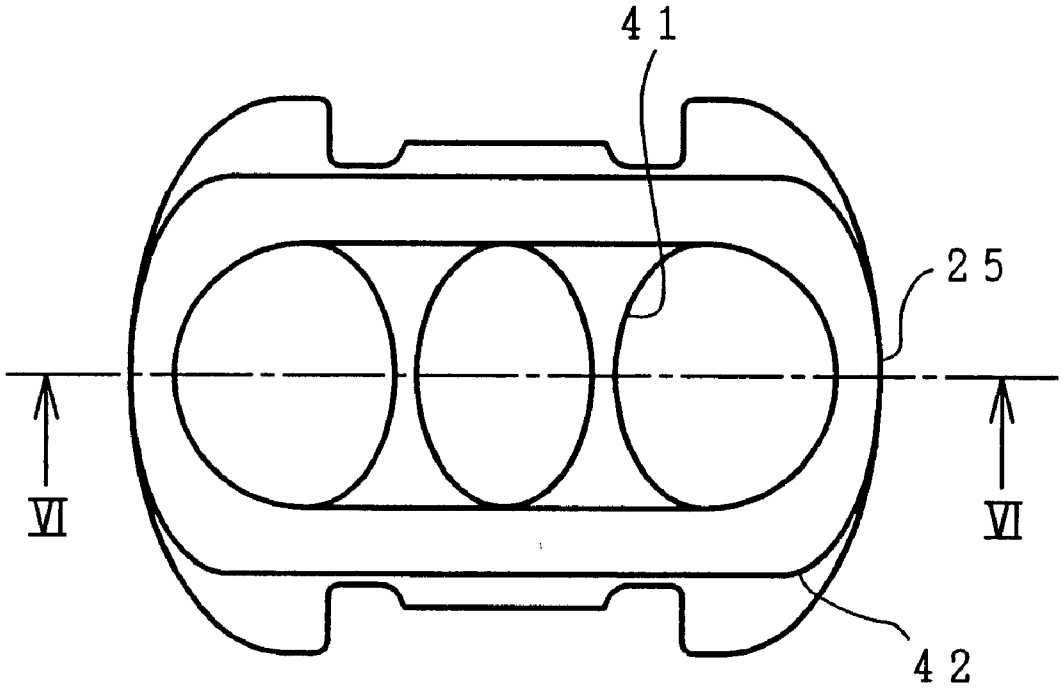
FIG. 5 is a plan view of an anode taken along line V—V of FIG. 2.
Figure 6:
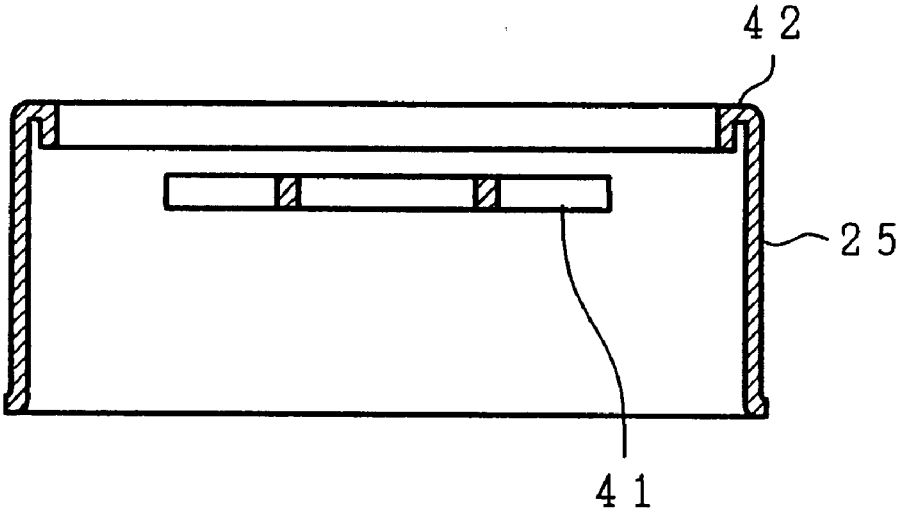
FIG. 6 is a cross-sectional view of the anode taken alo ng line VI—VI of FIG. 5.
Figure 7:
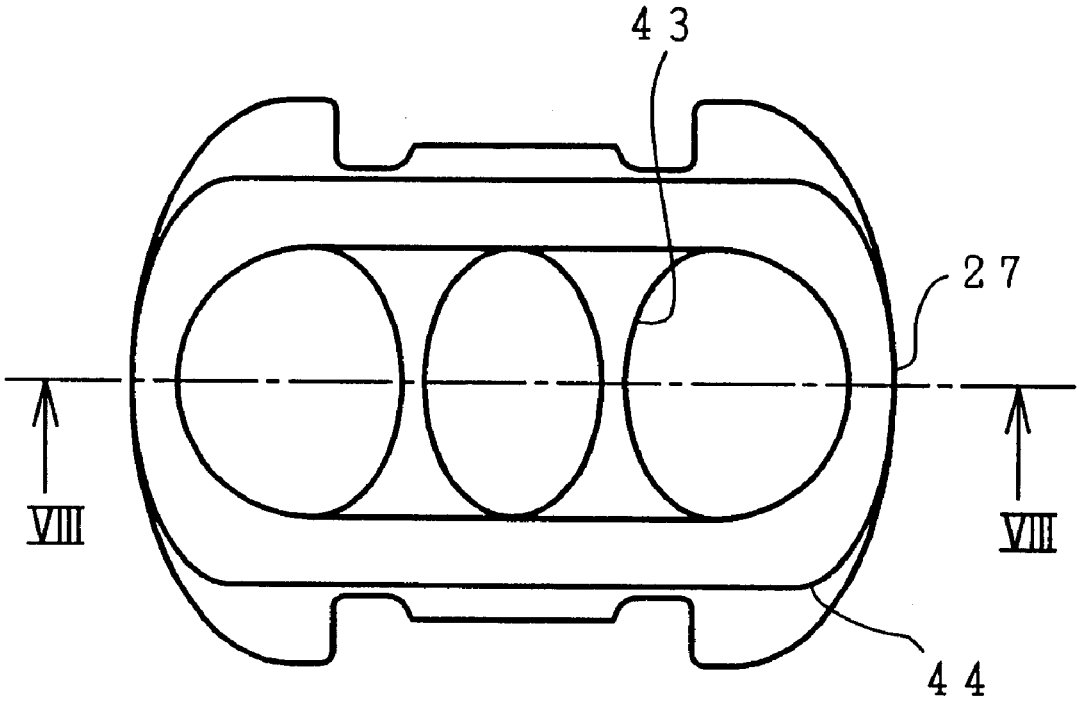
FIG. 7 is a plan view of an intermediate electrode taken along line VII—VII of FIG. 2.
Figure 8:
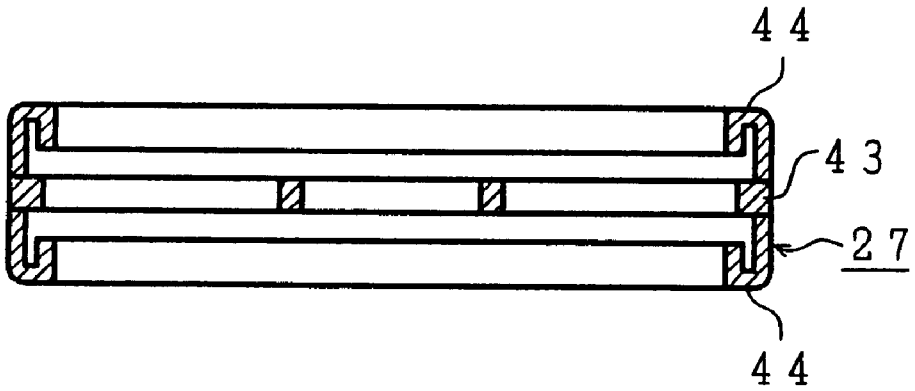
FIG. 8 is a cross-sectional view of the intermediate electrode taken along line VIII—VIII of FIG. 7.

FIG. 3 is a plan view of the third grid electrode 24 taken along line III—III of FIG. 2, FIG. 4 is a cross-sectional view of the third grid electrode 24 taken along line IV—IV of FIG. 3, FIG. 5 is a plan view of the anode 25 taken along line V—V of FIG. 2, FIG. 6 is a cross-sectional view of the anode 25 taken along line VI—VI of FIG. 5, FIG. 7 is a plan view of the intermediate electrode 27 taken along line VII—VII of FIG. 2, and FIG. 8 is a cross-sectional view of the intermediate electrode 27 taken along line VIII—VIII of FIG. 7.

In the color cathode ray tube of this embodiment explained in connection with FIGS. 1 to 8, the diagonal length D of the usable display area 19 (see FIG. 17) of the viewing screen, the distance L from the center of the phosphor screen to the end of the anode on its focus electrode side, and the outside diameter d of the neck portion are selected to be 460 mm, 292.9 mm and 24.3 mm, respectively, resulting in the ratio D/L of 1.57.

The distance L of this embodiment is approximately equal to that of a prior art color cathode ray tube with D being 410 mm and D/L being 1.4 and therefore the overall length of this embodiment is reduced to that of the prior art color cathode ray tube.

Figure 23:
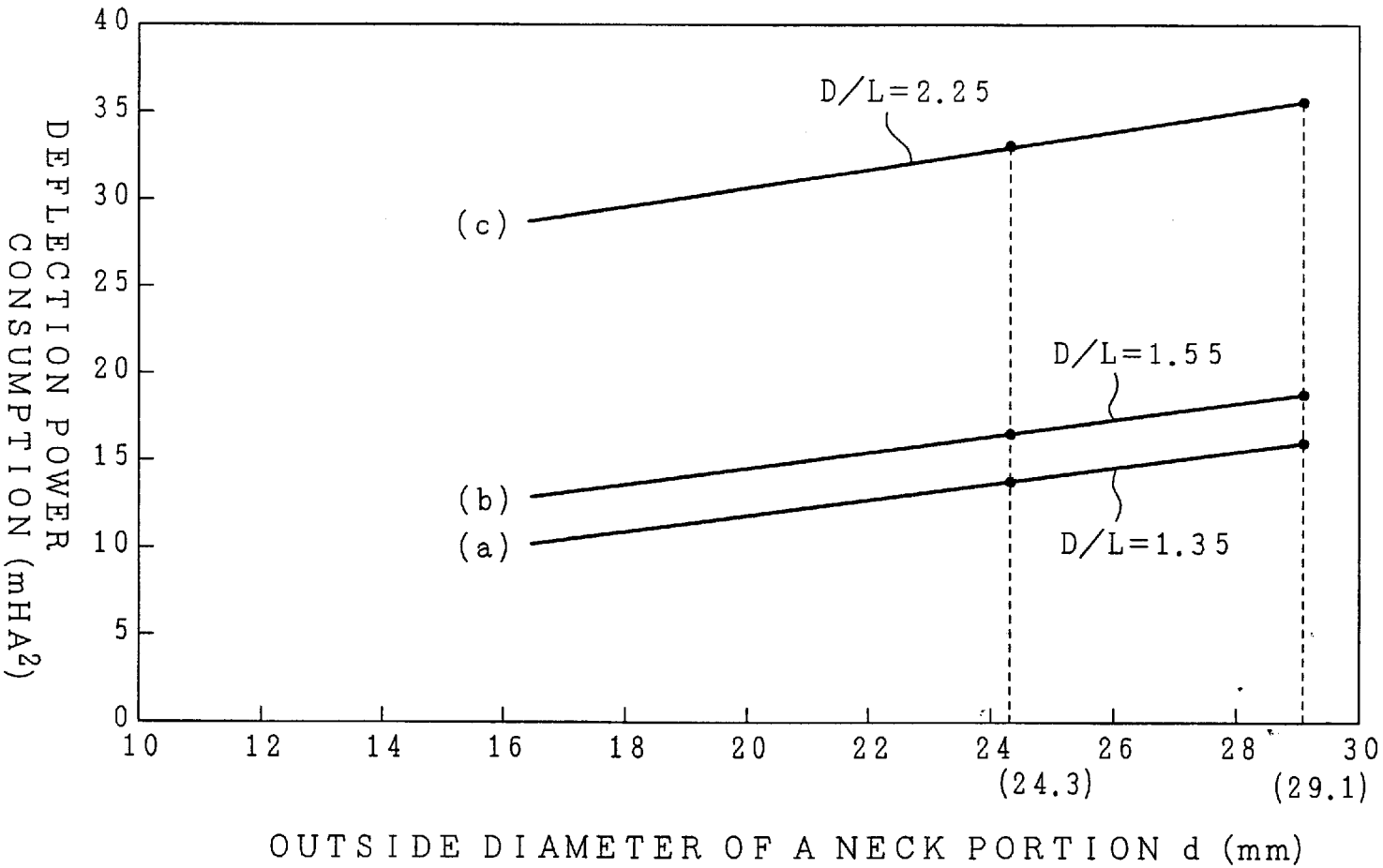
FIG. 23 is a graph showing the relationship between the deflection power consumption ($mHA^2$) and the outside diameter d (mm) of the glass neck tubes with the ratio D/L as a parameter, where D (mm) is a diagonal length of the usable display area of the viewing screen, and L (mm) is a distance from the center of the phosphor screen to the end of the anode on its focus electrode side.
Figure 24:
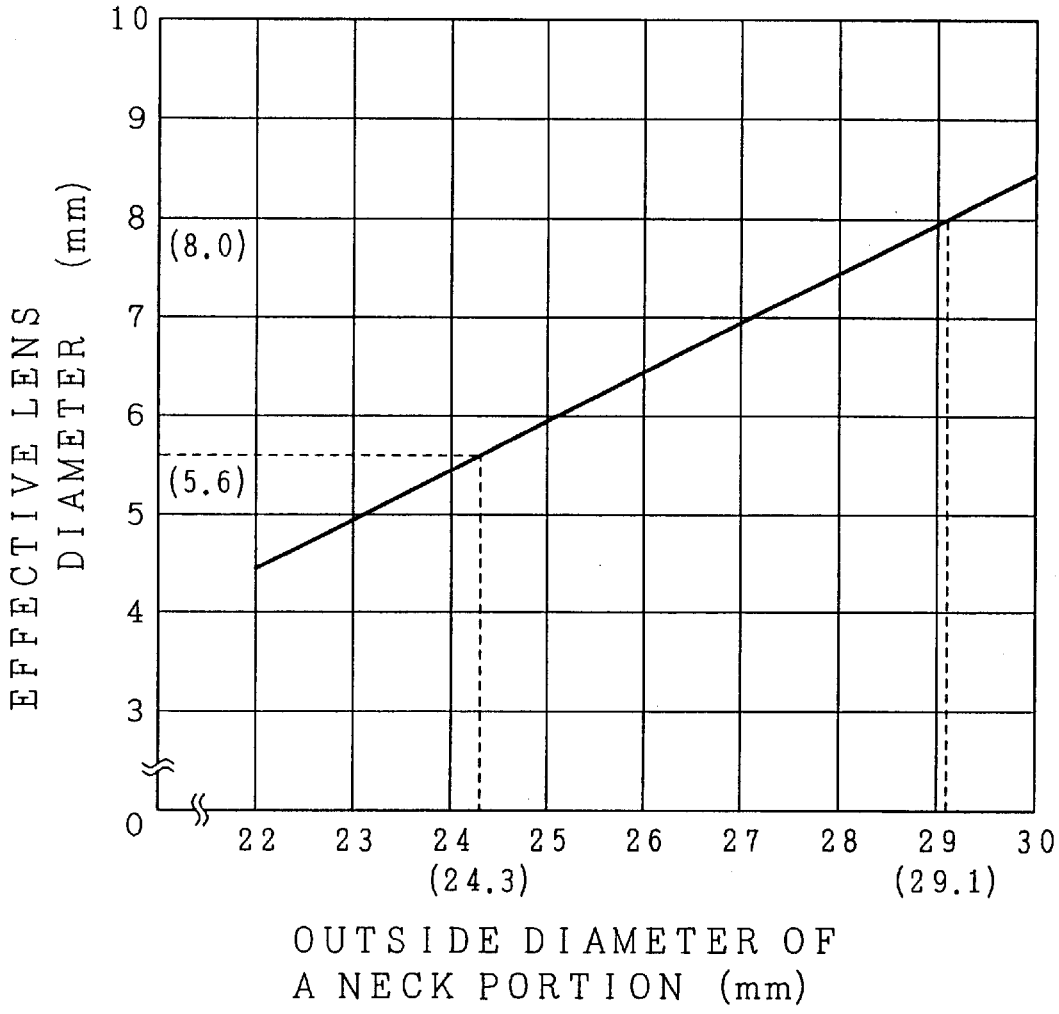
FIG. 24 is a graph showing the relationship between the outside diameter of the glass neck tubes and the effective lens diameter of the main lenses formed by the electrodes shown in FIGS. 19 to 22.
Figure 25:
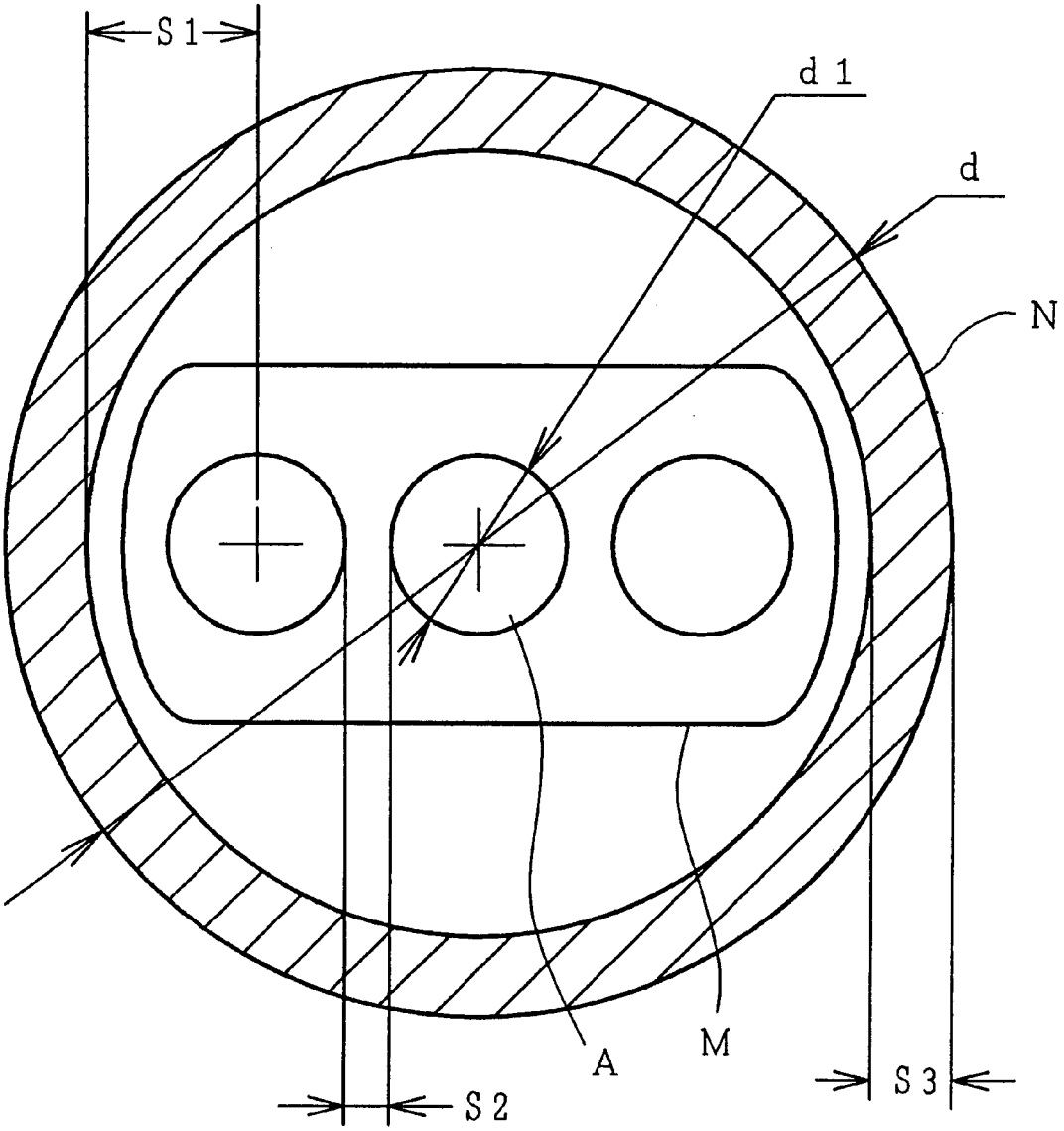
FIG. 25 is a schematic cross-sectional view of the neck portion for explaining the minimum usable outside diameter of the glass neck tube.
Figure 26:
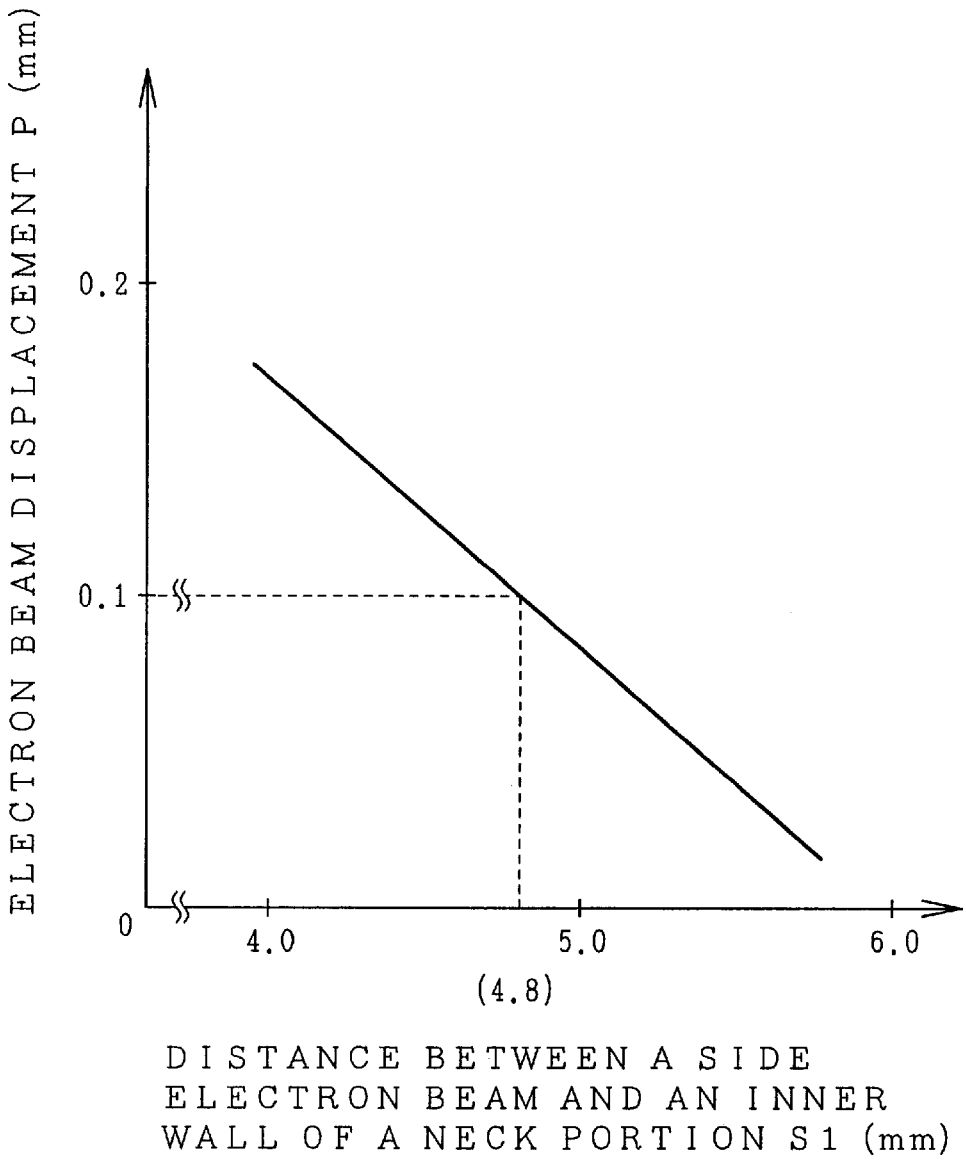
FIG. 26 is a graph showing the relationship between the displacement P of the electron beam spot on the phosphor screen after operation of 24 hours and the distance S1 from the center line of a path of the side electron beam to the inner wall of the glass neck tube.
Figure 27:
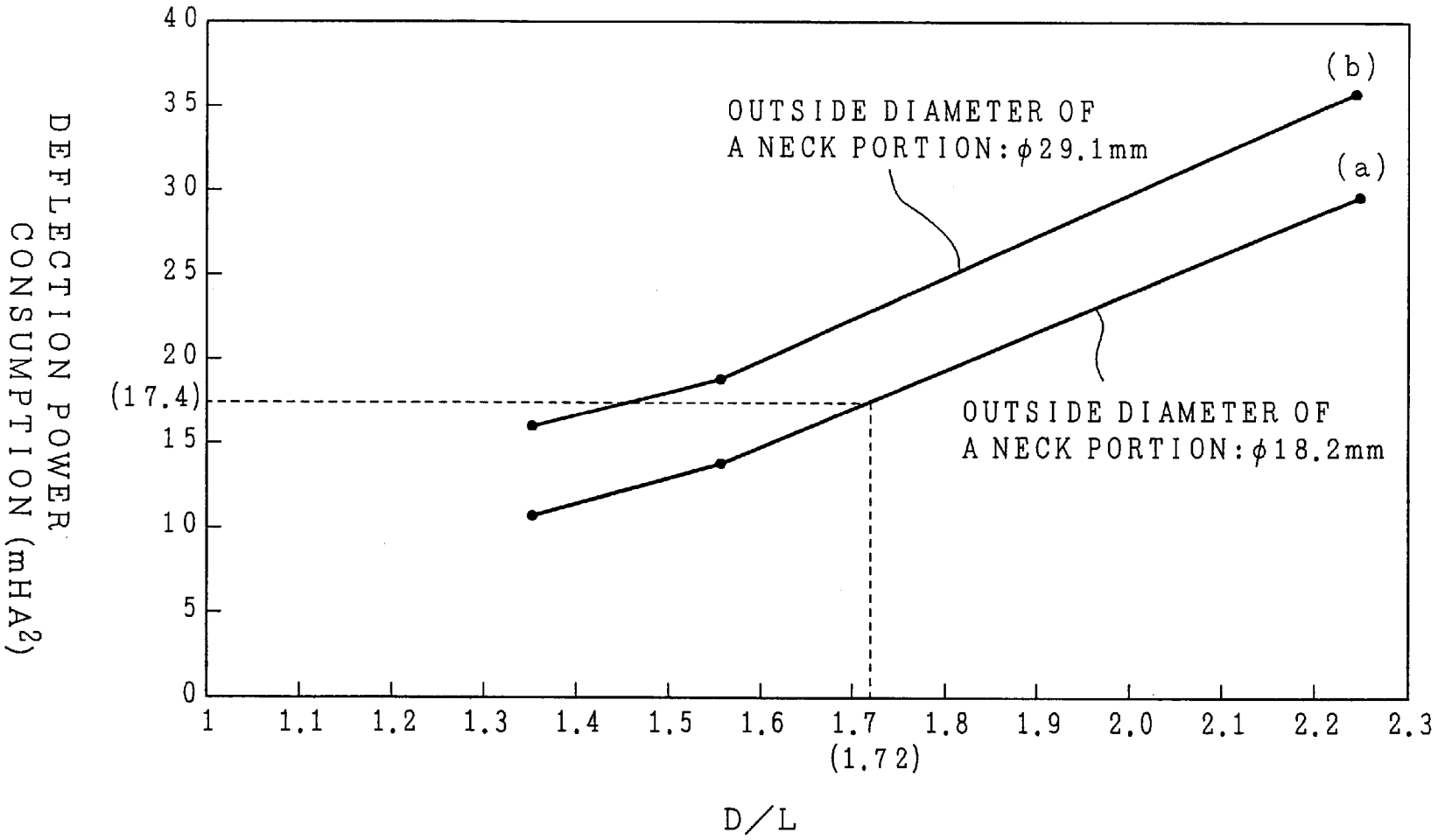
FIG. 27 is a graph showing the relationship between deflection power consumption and the ratio D/L of a diagonal length D of the usable display area of the viewing screen to a distance L from the center of the phosphor screen to the end of the anode on its focus electrode side for the outside diameters of the glass neck tubes of 18.2 mm and 29.1 mm.

In addition to this, the increase in the deflection power consumption in this embodiment is limited to about 3% compared with the prior art cathode ray tube, because the deflection power consumption became 16.3 $mHA^2$ as shown in FIG. 23 by reducing the outside diameter d of the neck portion 2 to 24.3 mm.

In FIGS. 3 and 4, reference 39 denotes an electric field correction plate having three vertically elongated electron beam apertures with their minor diameters in the in-line direction of the electron beams and reference numeral 40 denotes a racetrack electrode formed with a single opening with its major diameter in the in-line direction of the electron beams. The electric field correction plate 39 is retracted into the inside of the racetrack electrode 40 from its open end.

In FIGS. 5 and 6, reference 41 denotes an electric field correction plate having a vertically elongated electron beam aperture at the center with its minor diameter in the in-line direction of the electron beams and cutouts on opposite sides of the electron beam aperture and reference numeral 42 denotes a racetrack electrode formed with a single opening with its major diameter in the in-line direction of the electron beams. The electric field correction plate 41 is retracted into the inside of the racetrack electrode 42 from its open end.

In FIGS. 7 and 8, reference 43 denotes an electric field correction plate having three vertically elongated electron beam apertures with their minor diameters in the in-line direction of the electron beams and reference numeral 44 denote a pair of racetrack electrodes each formed with a single opening with its major diameter in the in-line direction of the electron beams. The pair of racetrack electrodes 44 are disposed to sandwich the electric field correction plate 43 such that the electric field correction plate 43 is retracted from the open ends of the racetrack electrodes 44.

The internal resistor 35 shown in FIG. 2 is attached closely to one of the insulating support rods 26, its anode terminal 36 is welded to the sidewall of the shield cup 12, the intermediate terminal 37 is welded to the sidewall of the intermediate electrode 27, and the low voltage terminal 38 is welded to the grounding terminal of the electron gun to be grounded via one of the stem pins 16. The internal resistor 35 divides the anode voltage to provide a high voltage lower than the anode voltage to the intermediate electrode 27.

The internal resistor 35 comprises a substrate made of ceramic, for example, a resistive film element made chiefly of ruthenium oxide and printed on the substrate, and an insulating glass coated on the resistive film, and its overall resistance is approximately in a range of 1 to 3 gigaohms.

The voltage applied to the intermediate electrode 27 is adjusted to a desired value by changing the ratio (0.55, for example) of a resistance between the intermediate terminal 37 and the low voltage terminal 38 to that between the anode terminal 36 and the low voltage terminal 38.

The contact springs 13 are attached to the front end of the shield cup 12 which in turn is welded to the anode 25. The anode voltage is applied to the anode 25 by the resilient contact springs 13 pressed against the internal conductive coating 11 on the inner wall of the funnel portion 3.

Figure 9:
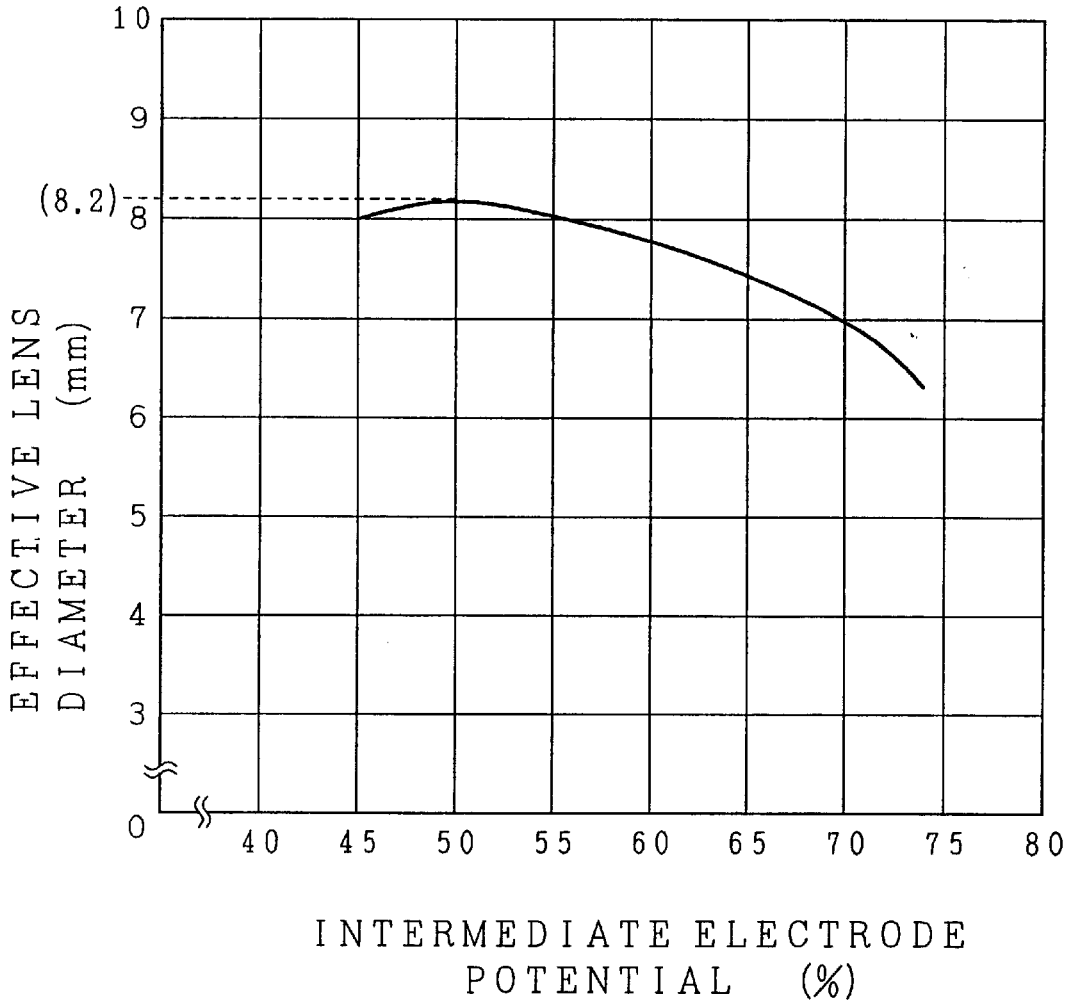
FIG. 9 is a graph showing the relationship between the voltage applied to the intermediate electrode and the effective diameter of the main lens for explaining an embodiment of a cathode ray tube in accordance with the present invention.

FIG. 9 is a graph showing the relationship between the effective diameter of the main lens and the potential of the intermediate electrode 27 for an example of a cathode ray tube of the present invention. FIG. 9 shows the relationship between the effective diameter of the main lens and the ratio of a voltage of the intermediate electrode 27 to the anode voltage obtained by computer simulation for an example in which the outside diameter of the glass neck tube is 24.3 mm and the axial length of the intermediate electrode 27 is 3 mm. FIG. 9 shows that application of 50% of the anode voltage to the intermediate electrode 27 provides the effective lens diameter of 8.2 mm, and this effective lens diameter is equivalent to that of the conventional electron guns used for the glass neck tube of 29.1 mm in outside diameter.

By this embodiment, the increase in deflection power consumption is reduced greatly, and also the high-definition display image is obtained.

The following describes a second embodiment which is useful especially for cathode ray tubes having the usable display area of 510 mm or less in diagonal length D.

By selecting the ratio D/L and the outside diameter d of the glass neck tube N to satisfy the following inequalities, $$D/L \geqq 1.57, d \leqq 26 \text{ mm},$$

the distance L from the center of the phosphor screen to the end of the anode on its focus electrode side is reduced from 364 mm to 325 mm, as a result the depth of a monitor set can be shortened and the usable space on the desk is increased, resulting in improvement of the efficiency of utilization of the space on the desk.

In the case of a cathode ray tube having the usable display area of 510 mm or less in diagonal length, the dimension L becomes 325 mm or less, and consequently the decrease in the dimension L leads to improvement of working environment.

Figure 10:
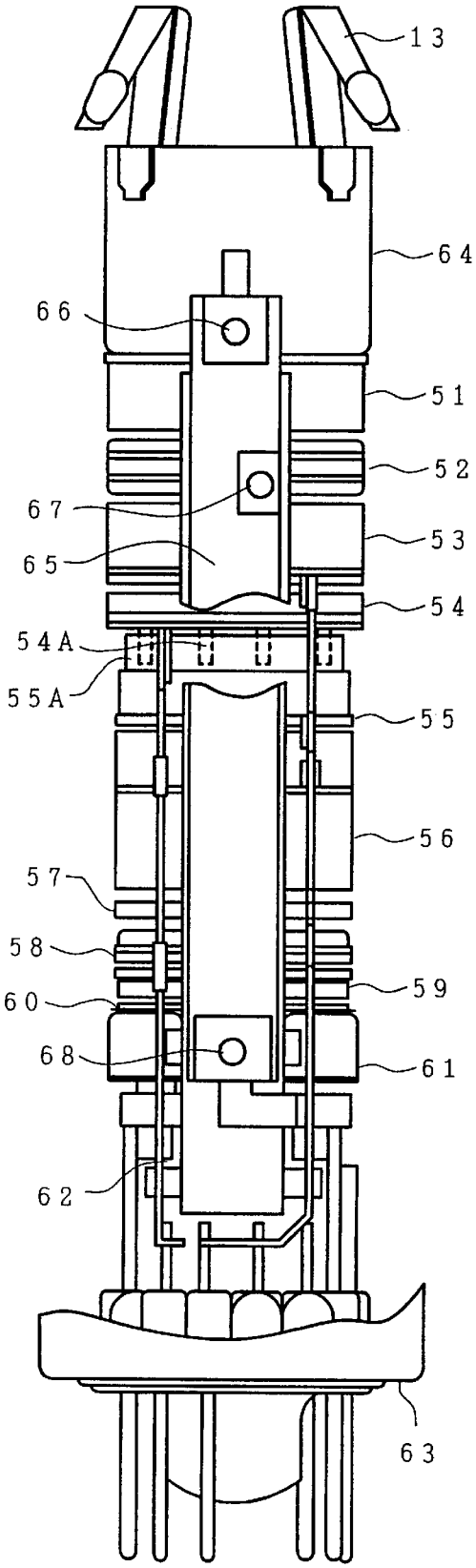
FIG. 10 is a side elevation view of an in-line type electron gun viewed in a direction perpendicular to the in-line direction of the electron beams for explaining another embodiment of a cathode ray tube in accordance with the present invention.

FIG. 10 is a side elevation view of an in-line type electron gun viewed in a direction perpendicular to the in-line direction of three electron beams for explaining a cathode ray tube of the second embodiment. In FIG. 10, reference numeral 51 denotes the anode, 52 is the intermediate electrode, 53 is the fourth member of the fifth grid electrode, 54 is the third member of the fifth grid electrode and 55 is the second member of the fifth grid electrode. Reference numeral 56 denotes the first member of the fifth grid electrode, 57 is the fourth grid electrode, 58 is the second member of the third grid electrode, 59 is the first member of the third grid electrode, 60 is the second grid electrode, 61 is the first grid electrode, 62 are the cathodes, and 63 is the stem.

Reference numeral 54A denote four vertical plates attached to the end of the third member 54 of the fifth grid electrode on its side facing the second member 55 of the fifth grid electrode, 55A are two horizontal plates attached to the end of the second member 55 of the fifth grid electrode on its side facing the third member 54 of the fifth grid electrode, and these vertical plates 54A and these horizontal plates 55A form a second-stage electrostatic quadrupole lens therebetween. Reference numeral 64 denotes the shield cup, 65 is the internal resistor, 66 is the anode terminal, 67 is the intermediate terminal and 68 is the low voltage terminal.

Figure 11:
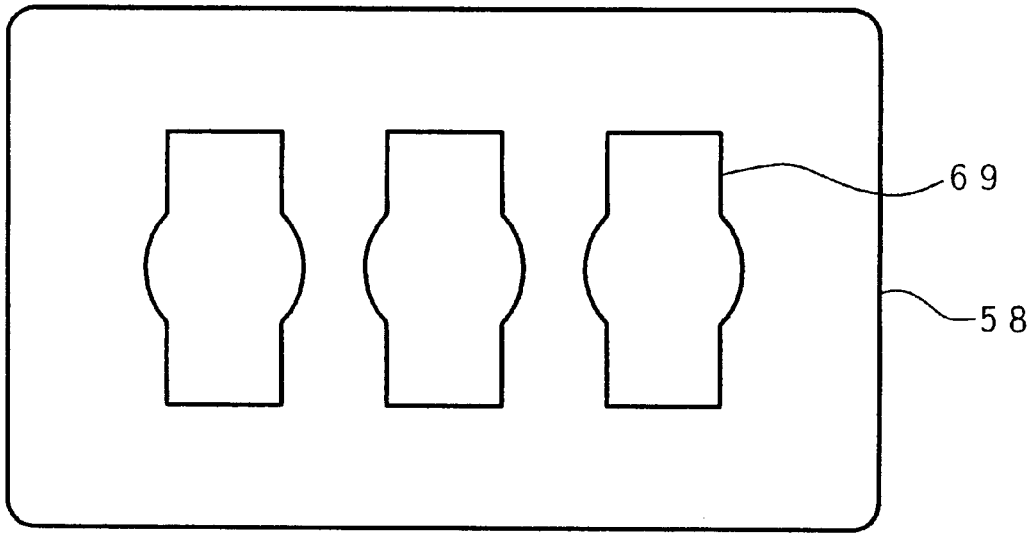
FIG. 11 is a schematic plan view of an end face of a second member of the third grid electrode on its side facing a first member of the third grid electrode of FIG. 10.
Figure 12:
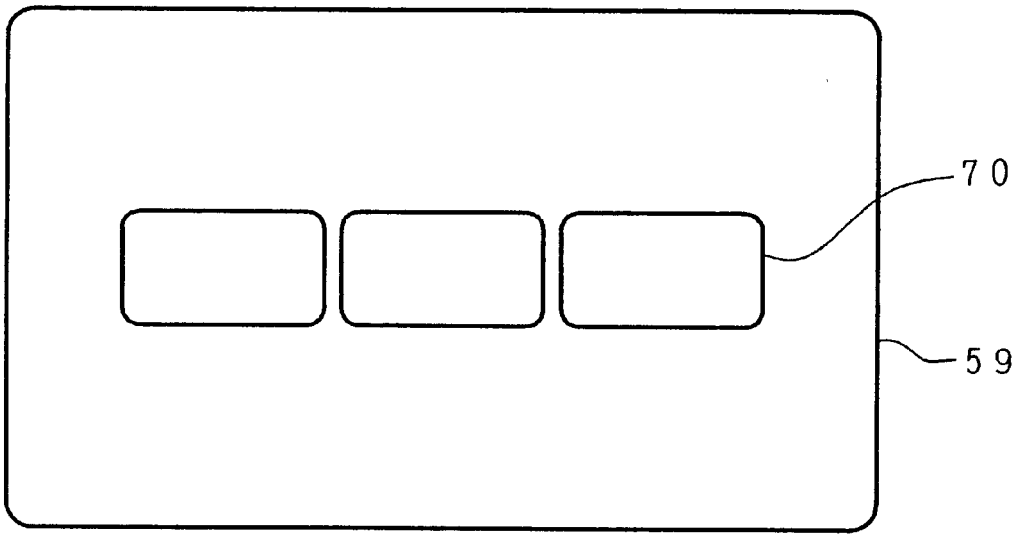
FIG. 12 is a schematic plan view of an end face of the first member of the third grid electrode on its side facing the second member of the third grid electrode of FIG. 10.
Figure 13:
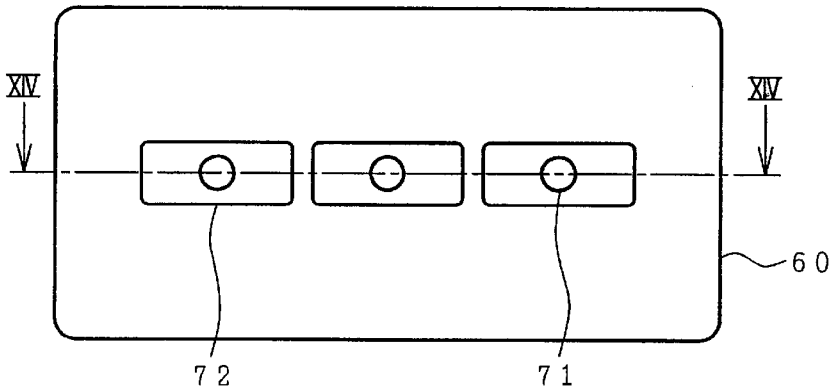
FIG. 13 is a schematic plan view of an end face of the second grid electrode on its side facing the first member of the third grid electrode of FIG. 10.
Figure 14:
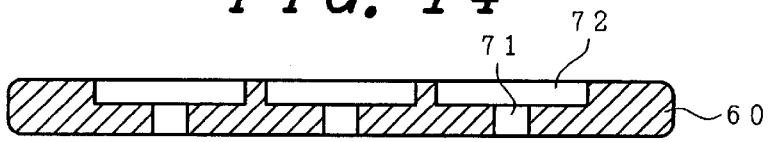
FIG. 14 is a cross-sectional view of the second grid electrode taken along line XIV—XIV of FIG. 13.

FIG. 11 is a schematic plan view of the end of the second member of the third grid electrode on its side facing the first member of the third grid electrode, FIG. 12 is a schematic plan view of the end of the first member of the third grid electrode on its side facing the second member of the third grid electrode, FIG. 13 is a schematic plan view of the second grid electrode on its side facing the first member of the third grid electrode, and FIG. 14 is a cross-sectional view of the second grid electrode taken along line XIV—XIV of FIG. 13.

In FIG. 10, the anode 51 is supplied with the anode voltage which is the highest voltage and the intermediate electrode 52 is supplied with the intermediate voltage which is 50 to 60% of the anode voltage via the internal resistor 65.

The fourth member 53 and the second member 55 of the fifth grid electrode and the second member 58 of the third grid electrode are connected with each other within the cathode ray tube and are supplied with a second focus voltage comprised of a fixed voltage of about 25% of the anode voltage superposed with a dynamic voltage increasing with increasing deflection of the electron beams. The third member 54 and the first member 56 of the fifth grid electrode and the first member 59 of the third grid electrode are internally connected with each other and are supplied with a first focus voltage of about 28% of the anode voltage. The fourth grid electrode 57 and the second grid electrode 60 are internally connected with each other and are supplied with a screen voltage of about 500V to about 800V, and the first grid electrode 61 is supplied with a voltage in a range of −50 to 0 volts.

Figure 15:
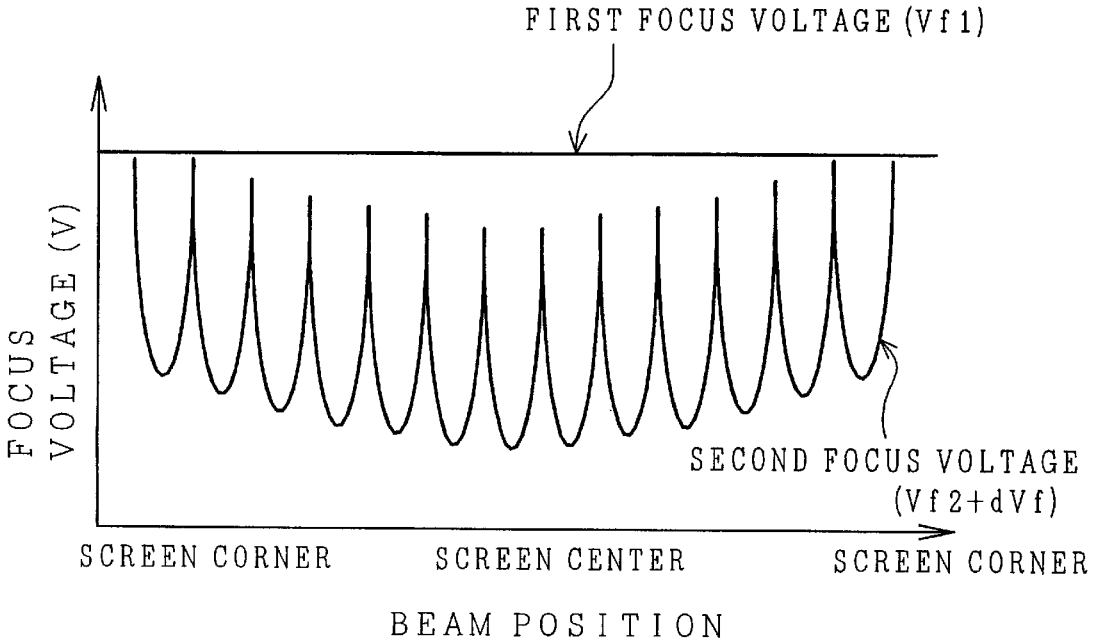
FIG. 15 is an illustration of waveforms of focus voltages.

FIG. 15 is an illustration of the magnitude of the focus voltages and their waveforms. The second focus voltage (Vf2 +dVf) is always lower than the first focus voltage (Vf1). But the second focus voltage (Vf2+dVf) can be sometimes selected such that it exceeds the first focus voltage (Vf1) slightly at the periphery of the viewing screen.

With this structure, the anode 51, the intermediate electrode 52 and the fourth member 53 of the fifth grid electrode 53 form a main lens thereamong.

The shapes of the grid electrodes are similar to those of the corresponding grid electrodes shown in FIGS. 3 to 8. The shapes of the apertures in the electric field correction plates and the distances by which the electric field correction plates are retracted into the inside of the racetrack electrodes from their open ends are optimized such that the main lens exerts horizontally strong focusing action on the electron beams.

The second-stage electrostatic quadrupole lens is formed between facing portions of the third member 54 and the second member 55 of the fifth grid electrode such that the vertically strong focusing action is exerted on the electron beams when the electron beams are not deflected and the strength of the vertically strong focusing action decreases with increasing deflection of the electron beams.

Two horizontal plates 55A are attached to the second member 55 of the fifth grid electrode such that they sandwich the electron beams in a direction perpendicular to the in-line direction of the electron beams and they extend toward the third member 54 of the fifth grid electrode, and the four vertical plates 54A are attached to the third member 54 of the fifth grid electrode such that they sandwich each of the electron beams in the in-line direction of the electron beams and they extend toward the second member 55 of the fifth grid electrode. The two horizontal plates 55A and the four vertical plates 54A form the second-stage electrostatic quadrupole lens.

One correction lens for the curvature of the image field is formed between the facing portions of the fourth member 53 and the third member 54 of the fifth grid electrode and another correction lens for the curvature of the image field is formed between the facing portions of the second member 55 and the first member 56 of the fifth grid electrode such that the focusing strengths of the correction lenses weaken with increasing deflection of the electron beams.

The first-stage electrostatic quadrupole lens is formed between the facing portions of the second member 58 and the first member 59 of the third grid electrode such that the horizontally strong focusing action is exerted on the electron beams when the electron beams are not deflected and the strength of the horizontally strong focusing action decreases with increasing deflection of the electron beams.

The portion of the second member 58 of the third grid electrode facing the first member 59 of the third grid electrode is formed with three keyholes 69 elongated in a direction perpendicular to the in-line direction of the electron beams as shown in FIG. 11, and the portion of the first member 59 of the third grid electrode facing the second member 58 of the third grid electrode is formed with three rectangular apertures 70 elongated in to the in-line direction of the electron beams as shown in FIG. 12.

The side of the second grid electrode 60 facing the first member 59 of the third grid electrode is formed with three circular apertures 71 each superposed with a larger slot 72 elongated in the in-line direction of the electron beams as shown in FIGS. 13 and 14.

This structure of the electron gun increases the effective lens diameter of the main lens by about 40% compared with a conventional electron gun which does not employ any intermediate electrodes unlike the present invention, and reduces the diameter of the electron beam spots over the entire viewing screen.

At the center of the viewing screen, the second-stage electrostatic quadrupole lens which focuses the electron beams strongly in a vertical direction cancels out the astigmatism of the main lens which focuses the electron beams strongly in a horizontal direction and the first-stage electrostatic quadrupole lens which focuses the electron beams strongly in the horizontal direction cancels out the astigmatism of the second grid electrode 60 which focuses the electron beams strongly in the vertical direction, to provide approximately circular electron beam spots.

At the periphery of the viewing screen, the focusing actions of the first-stage and second-stage electrostatic quadrupole lenses weaken and consequently the astigmatism of the main lens which focuses more strongly in a horizontal direction than in a vertical direction cancels out the astigmatism caused by the deflection magnetic fields which focuses more strongly in the vertical direction than in the horizontal direction.

Further, the second grid electrode 60 serves to make the beam spots approximately circular. Simultaneously with this, the focusing action of the correction lens for curvature of the image field and that of the main lens weaken to lengthen the focal length such that focusing of the electron beams are optimized even at the periphery of the viewing screen. This effect by the correction lens for curvature of the image field makes possible the reduction of the required magnitude of a dynamic voltage, and suppresses the increase in the dynamic voltage due to the increase in the maximum deflection angle.

Therefore in this embodiment also, the increase in deflection power consumption is minimized and the high definition image display is provided.

The following describes a third embodiment which is also useful especially for cathode ray tubes having the usable display area of 510 mm or less in diagonal length.

Figure 28:
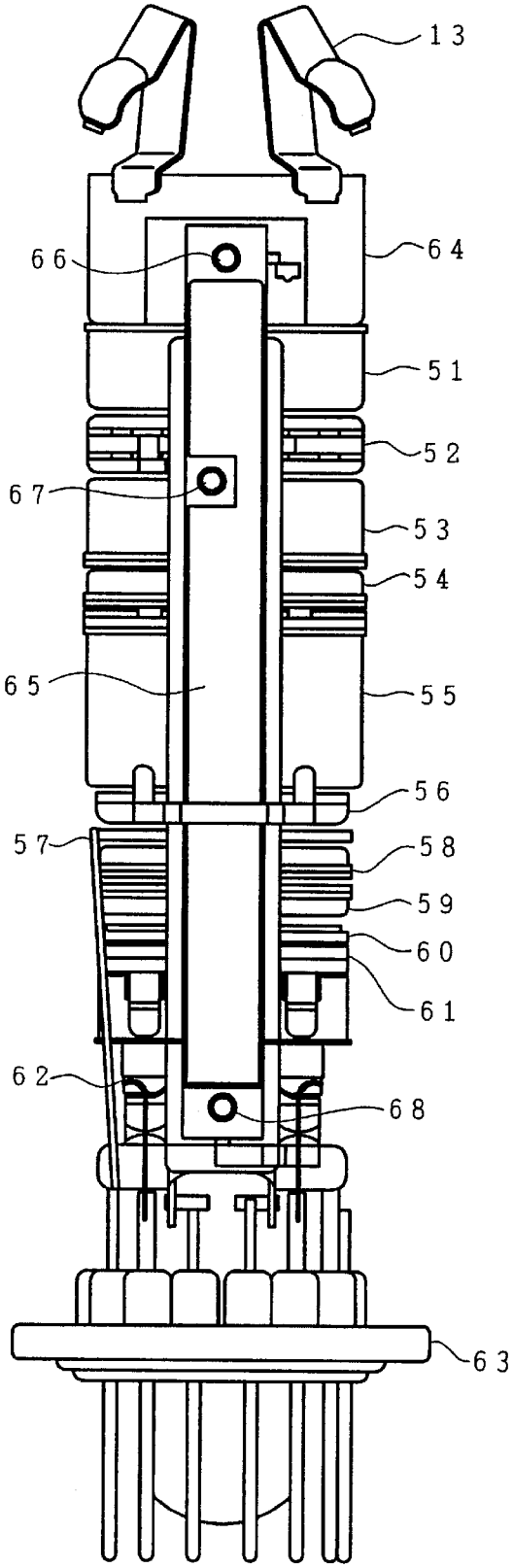
FIG. 28 is a side elevation view of an in-line type electron gun viewed in a direction perpendicular to the in-line direction of three electron beams for explaining a cathode ray tube of a third embodiment of the present invention.

FIG. 28 is a side elevation view of an in-line type electron gun viewed in a direction perpendicular to the in-line direction of three electron beams for explaining a cathode ray tube of the third embodiment. The same reference numerals as utilized in FIG. 10 designate corresponding portions in FIG. 28.

The structure of the color cathode ray tube in the third embodiment may be substantially the same as that in the second embodiment, except for the structures of the electrostatic quadrupole lenses formed within the fifth grid electrode.

Figure 29:
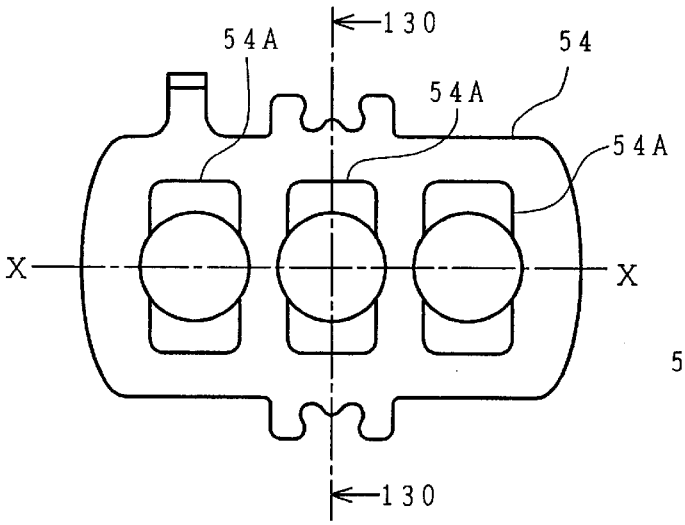
FIG. 29 is a front view of the side of the third member 54 of the fifth grid electrode facing the second member 55 of the fifth grid electrode of FIG. 28.
Figure 30:
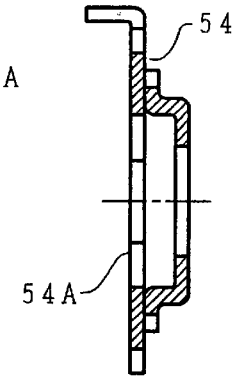
FIG. 30 is a cross-sectional view of the third member 54 of the fifth grid electrode 54 taken along line 130—130 of FIG. 29.
Figure 31:
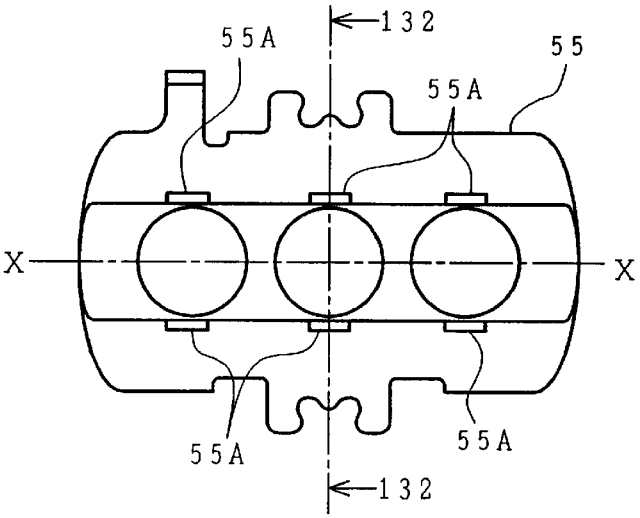
FIG. 31 is a front view of the side of the second member 55 of the fifth grid electrode facing the third member 54 of the fifth grid electrode of FIG. 28.
Figure 32:
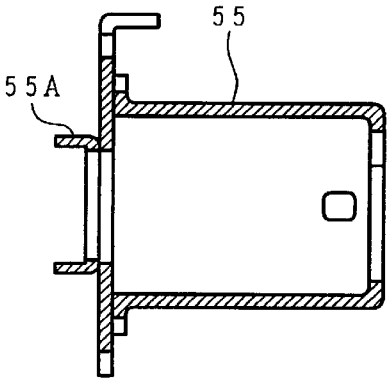
FIG. 32 is a cross-sectional view of the second member 55 of the fifth grid electrode 54 taken along line 132—132 of FIG. 31.
Figure 33:
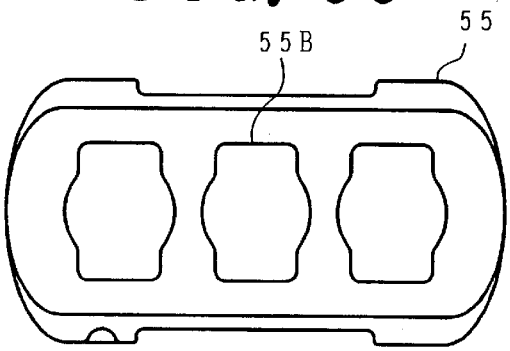
FIG. 33 is a front view of the side of the second member 55 of the fifth grid electrode facing the first member 56 of the fifth grid electrode of FIG. 28.

FIG. 29 is a front view of the side of the third member 54 of the fifth grid electrode facing the second member 55 of the fifth grid electrode, FIG. 30 is a cross-sectional view of the third member 54 of the fifth grid electrode 54 taken along line 130—130 of FIG. 29, FIG. 31 is a front view of the side of the second member 55 of the fifth grid electrode facing the third member 54 of the fifth grid electrode, FIG. 32 is a cross-sectional view of the second member 55 of the fifth grid electrode 54 taken along line 132—132 of FIG. 31. FIG. 33 is a front view of the side of the second member 55 of the fifth grid electrode facing the first member 56 of the fifth grid electrode.

The third-stage electrostatic quadrupole lens is formed between facing portions of the third member 54 and the second member 55 of the fifth grid electrode such that the vertically strong focusing action is exerted on the electron beams when the electron beams are not deflected and the strength of the vertically strong focusing action decreases with increasing deflection of the electron beams.

Three pairs of horizontal plates 55A are attached to the second member 55 of the fifth grid electrode such that each pair of the horizontal plates 55A sandwich each of the electron beams in a direction perpendicular to the in-line direction of the electron beams and they extend into a respective electron beam aperture 54A formed in the third member 54 of the fifth grid electrode. The electron beam apertures 54A are of the shape of a keyhole with its major diameter in a direction perpendicular to the in-line direction of the electron beams. One of the keyhole apertures 54A and an associated pair of horizontal plates 55A form a respective third-stage electrostatic quadrupole lens.

A correction lens for the curvature of the image field is formed between the facing portions of the fourth member 53 and the third member 54 of the fifth grid electrode such that the focusing strength of the correction lens weakens with increasing deflection of the electron beams.

The first-stage and second-stage electrostatic quadrupole lenses are formed between the facing portions of the second member 58 and the first member 59 of the third grid electrode, and between the facing portions of the second member 55 and the first member 56 of the fifth grid electrode, respectively, such that the horizontally strong focusing action is exerted on the electron beams when the electron beams are not deflected and the strength of the horizontally strong focusing action decreases with increasing deflection of the electron beams.

The side of the second member 55 of the fifth grid electrode facing the first member 56 of the fifth grid electrode is formed with three keyholes 55B with their major diameter in a direction perpendicular to the in-line direction of the electron beams as shown in FIG. 33, and the side of the first member 56 of the fifth grid electrode facing the second member 55 of the fifth grid electrode is formed with three circular apertures, to form a second-stage electrostatic quadrupole lens between the second and first members of the fifth grid electrodes.

The side of the second member 58 of the third grid electrode facing the first member 59 of the third grid electrode is formed with three keyholes 69 with their major diameters in a direction perpendicular to the in-line direction of the electron beams as shown in FIG. 11, and the side of the first member 59 of the third grid electrode facing the second member 58 of the third grid electrode is formed with three rectangular apertures 70 elongated in to the in-line direction of the electron beams as shown in FIG. 12, to form a first-stage electrostatic quadrupole lens between the second and first members of the fifth grid electrodes.

The side of the second grid electrode 60 facing the first member 59 of the third grid electrode is formed with three circular apertures 71 each superposed with a larger slot 72 elongated in the in-line direction of the electron beams as shown in FIGS. 13 and 14.

This structure of the electron gun increases the effective lens diameter of the main lens by about 40% compared with a conventional electron gun which does not employ any intermediate electrodes unlike the present invention, and reduces the diameter of the electron beam spots over the entire viewing screen.

At the center of the viewing screen, the third-stage electrostatic quadrupole lens which focuses the electron beams strongly in a vertical direction cancels out the astigmatism of the main lens which focuses the electron beams strongly in a horizontal direction and the first-stage and second-stage electrostatic quadrupole lenses which focus the electron beams strongly in the horizontal direction cancels out the astigmatism of the second grid electrode 60 which focuses the electron beams strongly in the vertical direction, to provide approximately circular electron beam spots.

At the periphery of the viewing screen, the focusing actions of the third-stage, first-stage and second-stage electrostatic quadrupole lenses weaken and consequently the astigmatism of the main lens which focuses more strongly in a horizontal direction than in a vertical direction cancels out the astigmatism caused by the deflection magnetic fields which focuses more strongly in the vertical direction than in the horizontal direction.

Further, the second grid electrode 60 serves to make the beam spots approximately circular. Simultaneously with this, the focusing action of the correction lens for curvature of the image field and that of the main lens weaken to lengthen the focal length such that focusing of the electron beams are optimized even at the periphery of the viewing screen. This effect by the correction lens for curvature of the image field makes possible the reduction of the required magnitude of a dynamic voltage, and suppresses the increase in the dynamic voltage due to the increase in the maximum deflection angle.

Therefore in this embodiment also, the increase in deflection power consumption is minimized and the high definition image display is provided.

Figure 34:
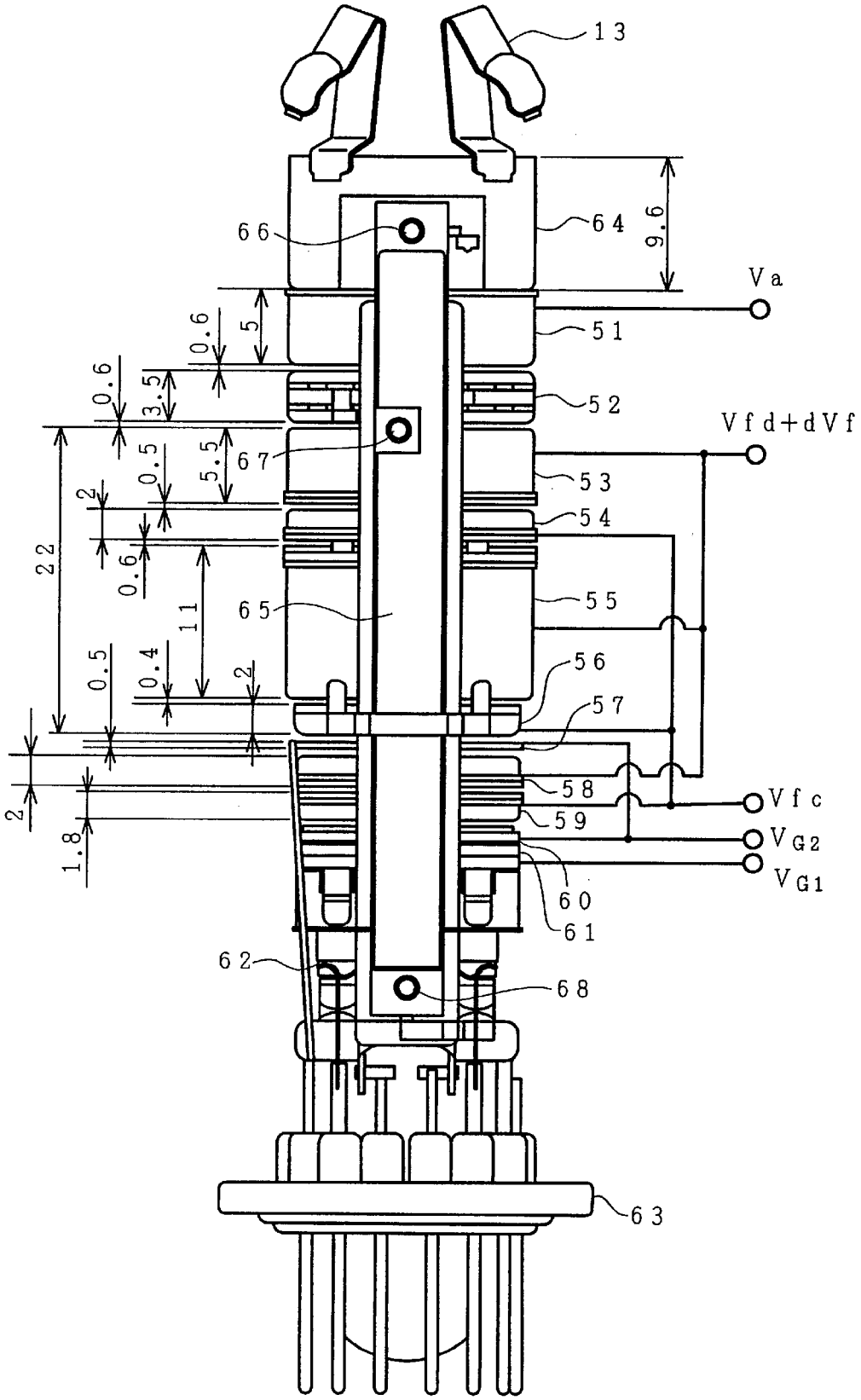
FIG. 34 is a side elevation view of an in-line type electron gun viewed in a direction perpendicular to the in-line direction of three electron beams for explaining a dimensional example of the third embodiment of the present invention.

The following explains the configuration of an in-line type electron gun, the dimensions of the major electrodes and the voltages applied to the electrodes of the in-line type electron gun in a cathode ray tube having a neck portion of 24.3 mm in outside diameter in accordance with an embodiment of the present invention, whose plan view viewed in a direction perpendicular to the in-line direction of the electron beams is shown in FIG. 34. The same reference numerals as utilized in FIG. 28 designate corresponding portions in FIG. 34.

The following are axial lengths of the major electrodes: Anode 51=5 mm, Intermediate electrode 52=3.5 mm, Fourth member 53 of the fifth grid electrode=5.5 mm, Third member 54 of the fifth grid electrode=2 mm, Second member 55 of the fifth grid electrode is 11 mm, First member 56 of the fifth grid electrode=2 mm, Fourth grid electrode 57=0.5 mm, Second member 58 of the third grid electrode=2 mm, First member 59 of the third grid electrode=1.8 mm, and Shield cup 64=9.6 mm.

The following are interelectrode spacings: Anode 51–Intermediate electrode 52=0.6 mm, Intermediate electrode 52–Fourth member 53 of the fifth grid electrode=0.6 mm, Fourth member 53–Third member 54, of the fifth grid electrode=0.5 mm, Third member 54–Second member 55, of the fifth grid electrode=0.6 mm, Second member 55–First member 56, of the fifth grid electrode=0.4 mm, First member 56 of the fifth grid electrode–Fourth grid electrode 57=0.6 mm, Fourth grid electrode 57–Second member 58 of the third grid electrode=2 mm, and Second member 58–First member 59, of the third grid electrode=0.3 mm.

The anode 51 is supplied with an anode voltage Va of about 27 kV, and the intermediate electrode 52 is supplied with a voltage of about 55% of the anode voltage Va via the internal resistor 65 of about 2 GΩ. The fourth member 53, the second member 55 of the fifth grid electrode and the second member 58 of the third grid electrode are internally connected with each other within the cathode ray tube and are supplied with a voltage Vfd of about 25% of the anode voltage Va superposed with a dynamic voltage dVf of about 500 to 800 volts increasing with increasing deflection of the electron beams.

The third member 54 and the first member 56 of the fifth grid electrode and the first member 59 of the third grid electrode are internally connected with each other and are supplied with a voltage Vfc of about 28% of the anode voltage Va. The fourth grid electrode 57 and the second grid electrode 60 are internally connected with each other and are supplied with a screen voltage VG2 of about 600 volts.

Figure 35:
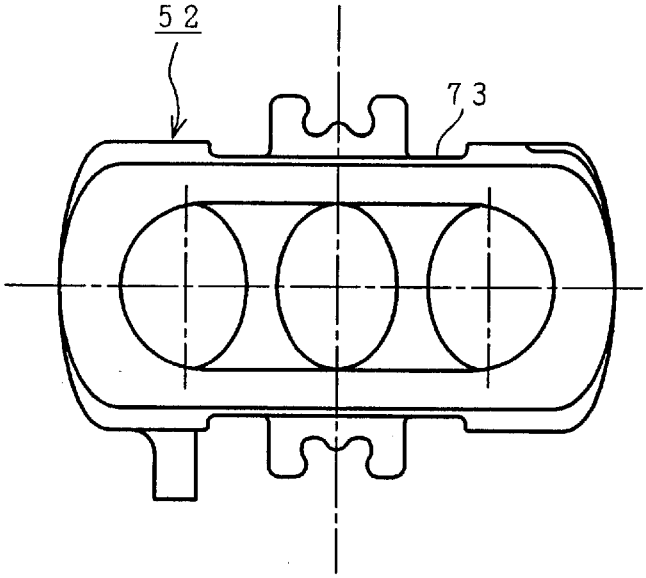
FIG. 35 is a front view of the side of the intermediate electrode 52 facing the anode 51 of FIG. 34.
Figure 36:
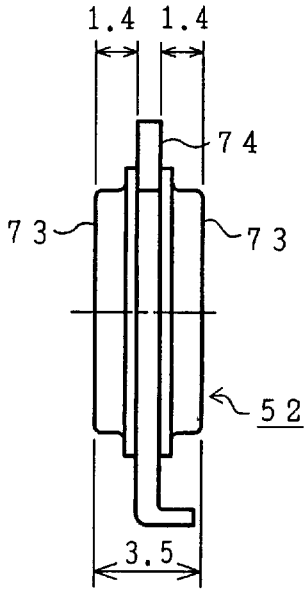
FIG. 36 is a side elevation view of the intermediate electrode 52 viewed in the in-line direction of the electron beams of FIG. 35.

FIG. 35 is a front view of the side of the intermediate electrode 52 facing the anode 51, and FIG. 36 is a side elevation view of the intermediate electrode 52 viewed in the in-line direction of the electron beams. The intermediate electrode 52 comprises a pair of cup-shaped electrodes 73 and a plate-like electrode 74 sandwiched between the pair of cup-shaped electrodes 73. The axial length of the intermediate electrode 52 is 3.5 mm.

Figure 37:
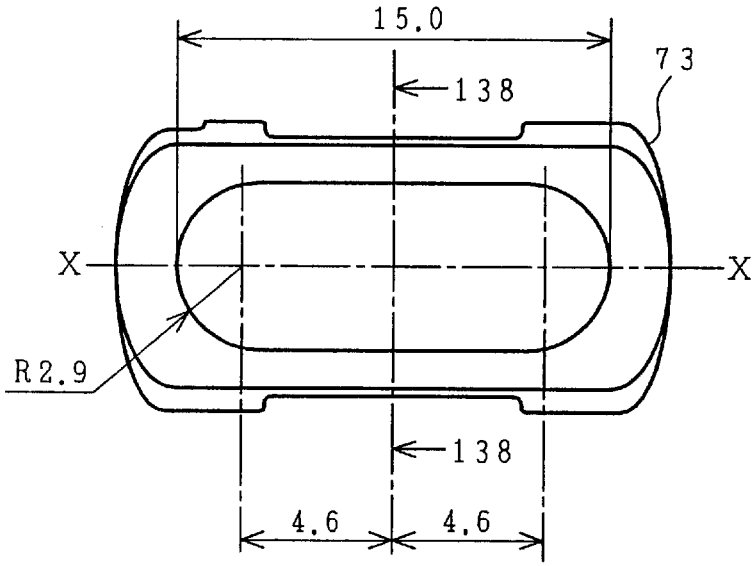
FIG. 37 is a plan view of the cup-shaped electrode 71 of FIG. 34.
Figure 38:
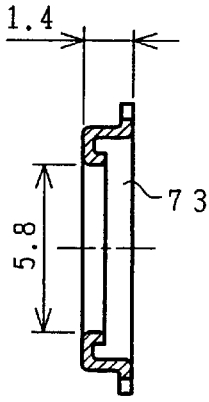
FIG. 38 is a cross-sectional view of the cup-shaped electrode 71 taken along line 138—138 of FIG. 37.

FIG. 37 is a plan view of the cup-shaped electrode 73 and FIG. 38 is a cross-sectional view of the cup-shaped electrode 73 taken along line 138—138 of FIG. 37. The cup-shaped electrode 73 is formed with a single opening elongated in the in-line direction of the electron beams which is 15 mm in major diameter and 5.8 mm in minor diameter with semicircles of 2.9 mm in radius at the left and right sides. The axial length of the cup-shaped electrode 73 is 1.4 mm.

Figure 39:
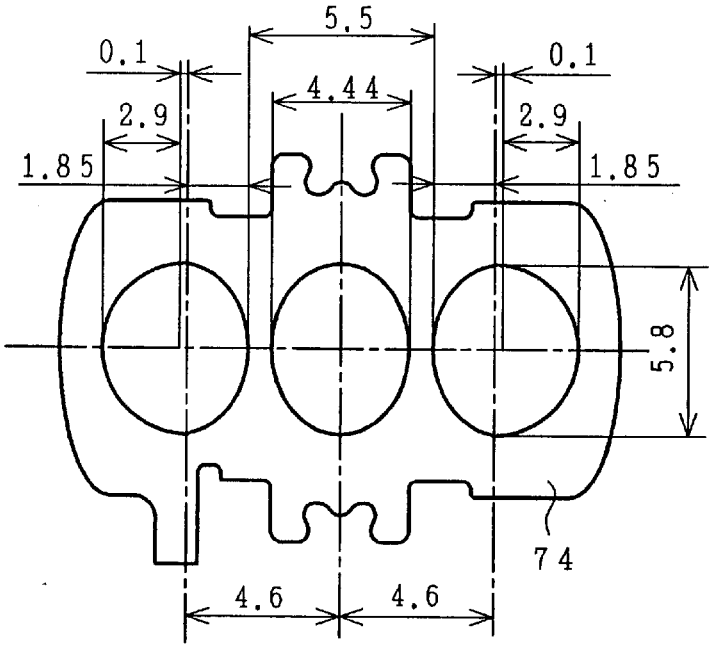
FIG. 39 is a plan view of the plate-like electrode 74 of FIG. 34.
Figure 40:
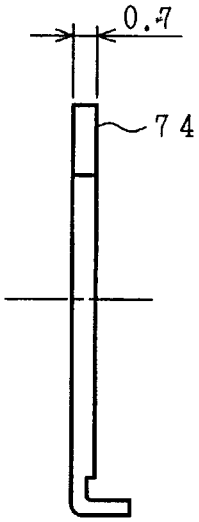
FIG. 40 is a side elevation view of the plate-like electrode 74 of FIG. 39.

FIG. 39 is a plan view of the plate-like electrode 74 and FIG. 40 is a side elevation view of the plate-like electrode 74. In FIG. 39, the center electron beam aperture is an ellipse represented by the equation (1), $$(X/2.22)^2+(Y/2.9)^2=1 \quad (1),$$

where the X-axis is in the in-line direction of the electron beams and the Y-axis is perpendicular to the in-line direction, an inner side portion of the side electron beam apertures is a semi-ellipse represented by the equation (2), $$(X/1.85)^2+(Y/2.9)^2=1 \quad (2),$$

and an outer side portion of the side electron beam apertures is a semicircle of 2.9 mm in radius.

Figure 41:
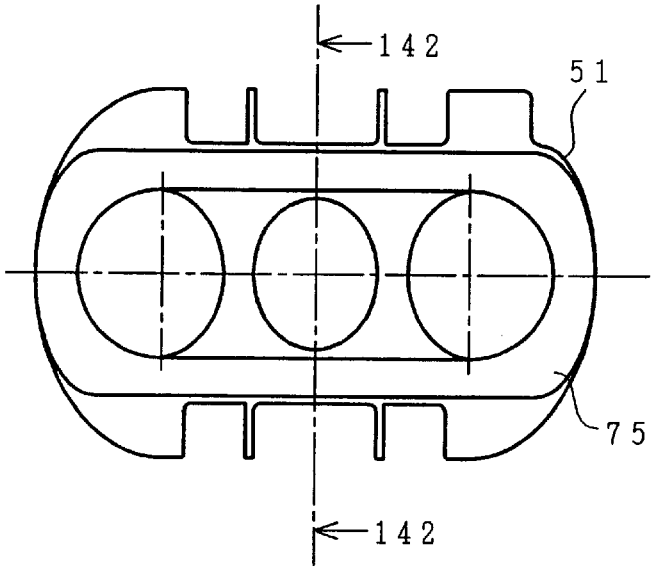
FIG. 41 is a plan view of the side of the anode 51 facing the fourth member 52 of the fifth grid electrode of FIG. 34.
Figure 42:
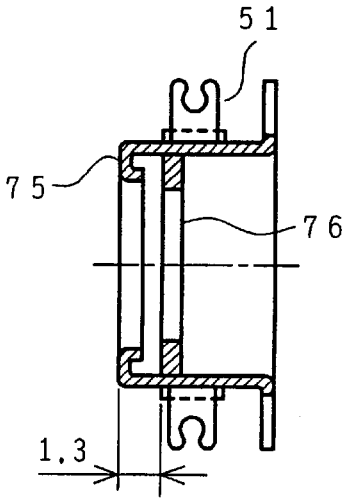
FIG. 42 is a cross-sectional view of the anode 51 taken along line 142—142 of FIG. 41.

FIG. 41 is a plan view of the side of the anode 51 facing the intermediate electrode 52, and FIG. 42 is a cross-sectional view of the anode 51 taken along line 142—142 of FIG. 41. The anode 51 is comprised of a cup-shaped electrode 75 and a plate-like electrode 76 which is welded at a distance of 1.3 mm spaced inwardly from the open end of the cup-shaped electrode 75.

Figure 43:
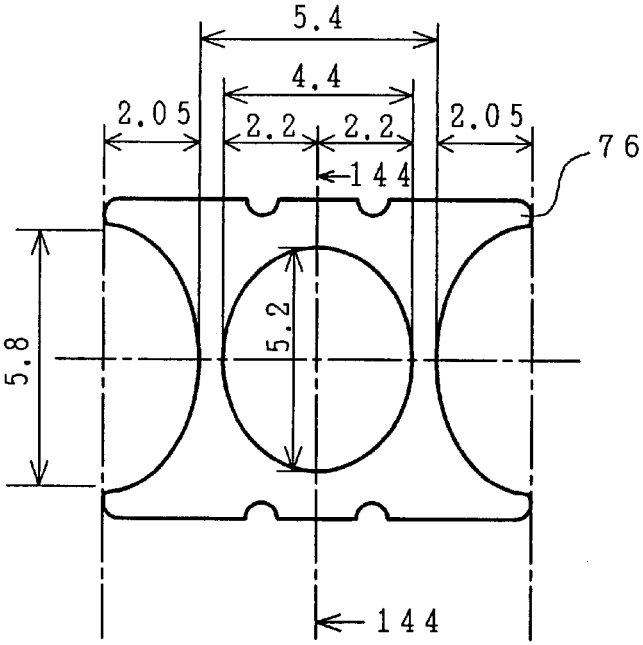
FIG. 43 is a plan view of the plate-like electrode 76 of FIG. 34.
Figure 44:
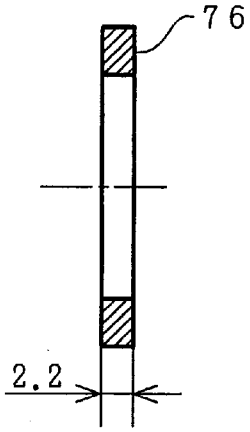
FIG. 44 is a cross-sectional view of the plate-like electrode 76 taken along line 144—144 of FIG. 43.

FIG. 43 is a plan view of the plate-like electrode 76, and FIG. 44 is a cross-sectional view of the plate-like electrode 76 taken along line 144—144 of FIG. 43. The center electron beam aperture is an ellipse represented by the equation (3), $$(X/2.2)^2+(Y/2.6)^2=1 \quad (3),$$

and an inner side portion of the side electron beam apertures is comprised of a semi-ellipse represented by the equation (4) and a straight line, $$(X/2.05)^2+(Y/3.0)^2=1 \quad (4).$$

Figure 45:
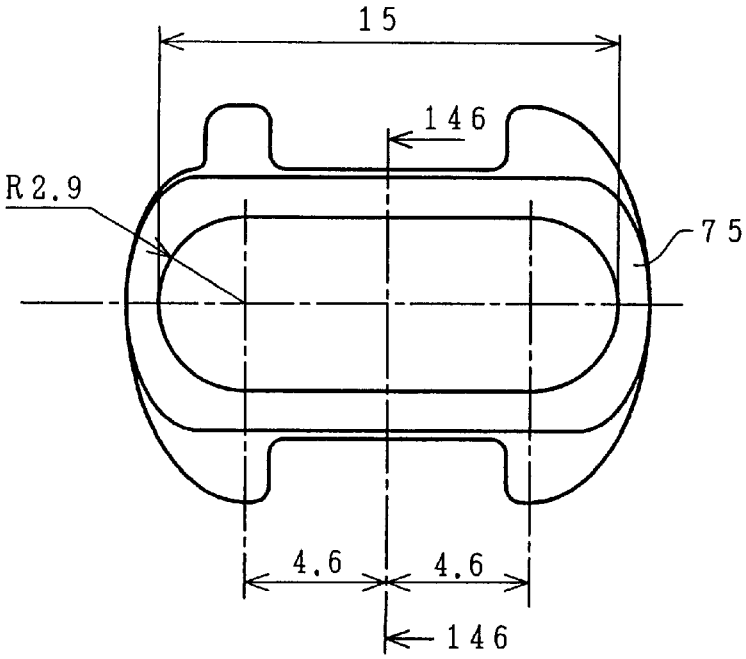
FIG. 45 is a front view of the cup-shaped electrode 75 of FIG. 34.
Figure 46:
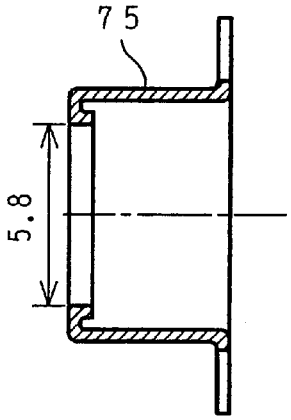
FIG. 46 is a cross-sectional view of the cup-shaped electrode 75 taken along line 146—146 of FIG. 45.

FIG. 45 is a front view of the cup-shaped electrode 75, and FIG. 46 is a cross-sectional view of the cup-shaped electrode 75 taken along line 146—146 of FIG. 45. The single opening in the cup-shaped electrode 75 is the same as that in FIG. 37.

Figure 47:
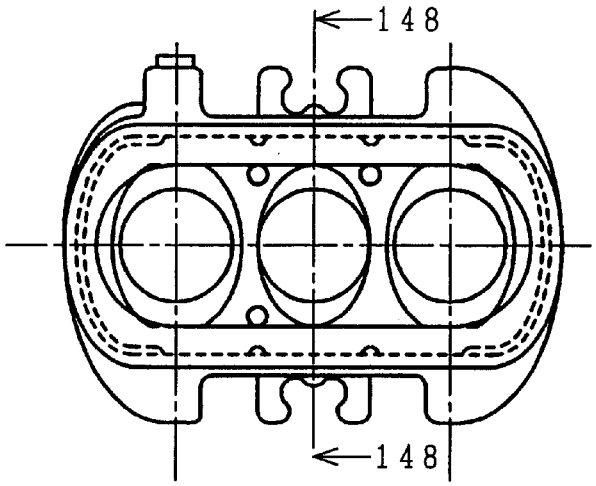
FIG. 47 is a front view of the side of the fourth member 53 of the fifth grid electrode facing the intermediate electrode 52 of FIG. 34.
Figure 48:
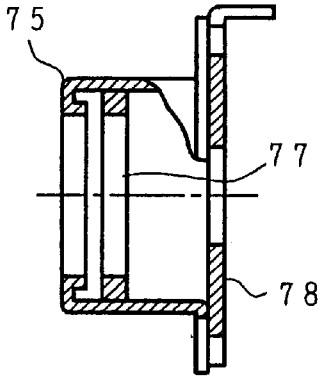
FIG. 48 is a cross-sectional view of the fourth member 53 taken along line 148—148 of FIG. 47.

FIG. 47 is a front view of the side of the fourth member 53 of the fifth grid electrode facing the intermediate electrode 52, and FIG. 48 is a cross-sectional view of the fourth member 53 taken along line 148—148 of FIG. 47. The cup-shaped electrode 75 is the same as in FIG. 41. The plate-like electrode 77 is welded at a distance of 1.3 mm spaced inwardly from the open end of the cup-shaped electrode 75.

Figure 49:
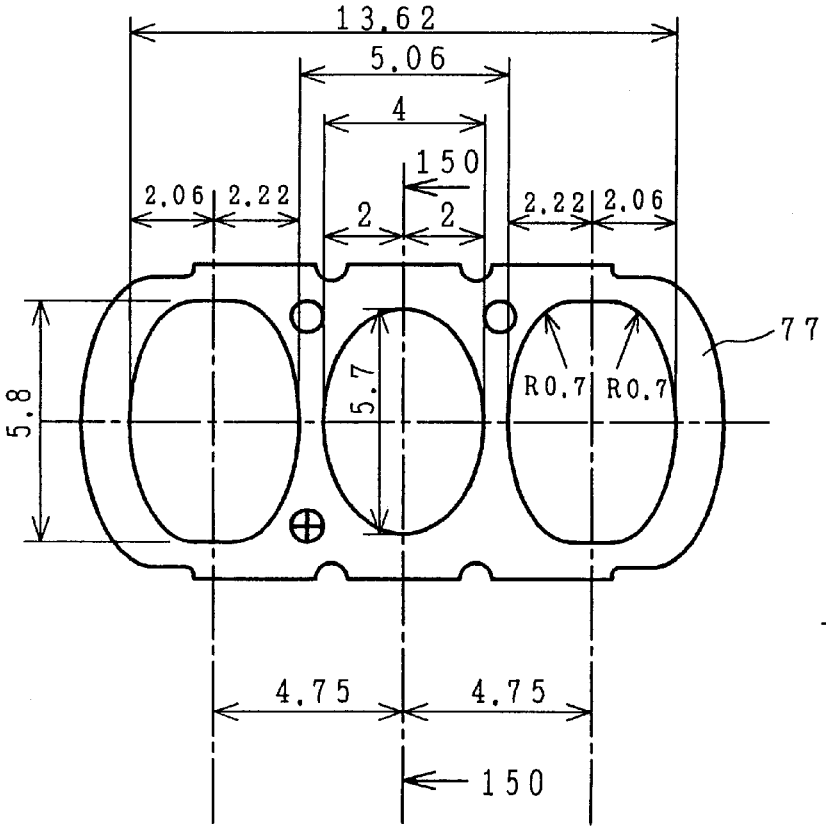
FIG. 49 is a plan view of the plate-like electrode 77 of FIG. 34.
Figure 50:
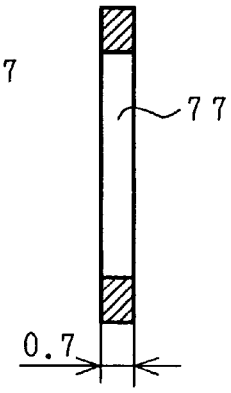
FIG. 50 is a cross-sectional view of the plate-like electrode 77 taken along line 150—150 of FIG. 49.

FIG. 49 is a plan view of the plate-like electrode 77, and FIG. 50 is a cross-sectional view of the plate-like electrode 77 taken along line 150—150 of FIG. 49. The center electron beam aperture is an ellipse represented by the equation (5), $$(X/2.0)^2+(Y/2.85)^2=1 \quad (5),$$

an inner side portion of the side electron beam apertures is a segment of a semi-ellipse represented by the equation (6)

$$(X/2.22)^2+(Y/3.50)^2=1 \quad (6),$$

an outer side portion of the side electron beam apertures is a segment of a semi-ellipse represented by the equation (7), $$(X/2.06)^2+(Y/3.50)^2=1 \quad (7),$$

and the inner and outer side portions of the side electron beam apertures are connected by two straight lines.

With this structure, the anode 51, the intermediate electrode 52 and the fourth member 53 of the fifth grid electrode form a main lens thereamong. This main lens is capable of being housed in a glass neck tube of 24.3 mm in outside diameter and provides a large effective lens diameter of 8.3 mm.

As explained above, in a cathode ray tube according to the present invention, even if the outside diameter of its glass neck tube is reduced so as to cancel out the increase in deflection power consumption caused by the increase in the maximum deflection angle, the effective lens diameter of the main lens is made approximately equal to that obtainable with the conventional glass neck tube of 29.1 mm in outside diameter, and consequently the present invention provides a high-performance cathode ray tube with its overall length shortened.

What is claimed is:

1. A color cathode ray tube comprising an evacuated envelope comprising a panel portion, a neck portion and a funnel portion for connecting said panel portion and said neck portion, a phosphor screen formed on an inner surface of said panel portion, an in-line type electron gun housed in said neck portion, and an electron beam deflection yoke mounted around a transition region between said funnel portion and said neck portion for generating magnetic deflection fields, said in-line type electron gun comprising:

an electron beam generating section having a plurality of in-line cathodes, an electron beam control electrode and an accelerating electrode arranged in the order named for generating and directing a plurality of electron beams along separate paths in a horizontal plane toward said phosphor screen, an electron beam focusing section for focusing said plurality of electron beams from said electron beam generating section onto said phosphor screen, said electron beam focusing section comprising a focus electrode, at least one intermediate electrode and an anode supplied with a highest voltage arranged in the order named, said at least one intermediate electrode being supplied with an intermediate voltage between said highest voltage and a voltage supplied to said focus electrode, wherein the following relationship is satisfied:

$$1.55 \leqq D/L \leqq 1.72,$$

and $$18.2\ \text{mm} \leqq d \leqq 26\ \text{mm}$$

where D (mm) is a diagonal length of a usable display area of said phosphor screen, L (mm) is a distance from a center of said phosphor screen to an end of said anode facing toward said focus electrode, and d (mm) is an outside diameter of said neck portion.

2. A color cathode ray tube according to claim 1, wherein said outside diameter d of said neck portion is approximately 24.3 mm.

3. A color cathode ray tube according to claim 1, wherein said focus electrode are subdivided into a plurality of electrode members, at least one first-type electron lens is formed by electrode members of said plurality of electrode members for focusing said plurality of electron beams in one of horizontal and vertical directions and diffusing said plurality of electron beams in another of the horizontal and vertical directions, a strength of said at least one first-type electron lens becoming weaker with increasing deflection of said plurality of electron beams, a second-type electron lens is formed by electrode members of said plurality of electrode members for exerting a focusing action on said plurality of electron beams weakening with the increasing deflection of said plurality of electron beams, and a main lens is formed by said anode, said at least one intermediate electrode and one of said plurality of electrode members facing said at least one intermediate electrode for focusing said plurality of electron beams stronger in a horizontal direction than in a vertical direction.

4. A color cathode ray tube according to claim 2, wherein said focus electrode are subdivided into a plurality of electrode members, at least one first-type electron lens is formed by electrode members of said plurality of electrode members for focusing said plurality of electron beams in one of horizontal and vertical directions and diffusing said plurality of electron beams in another of the horizontal and vertical directions, a strength of said at least one first-type electron lens becoming weaker with increasing deflection of said plurality of electron beams, a second-type electron lens is formed by electrode members of said plurality of electrode members for exerting a focusing action on said plurality of electron beams weakening with the increasing deflection of said plurality of electron beams, and a main lens is formed by said anode, said at least one intermediate electrode and one of said plurality of electrode members facing said at least one intermediate electrode for focusing said plurality of electron beams stronger in a horizontal direction than in a vertical direction.

5. A color cathode ray tube according to claim 1, wherein said at least one intermediate electrode is supplied with a voltage obtained by dividing said highest voltage with an internal resistor incorporated within said cathode ray tube.

6. A color cathode ray tube according to claim 2, wherein said at least one intermediate electrode is supplied with a voltage obtained by dividing said highest voltage with an internal resistor incorporated within said cathode ray tube.

7. A color cathode ray tube according to claim 3, wherein said at least one intermediate electrode is supplied with a voltage obtained by dividing said highest voltage with an internal resistor incorporated within said cathode ray tube.

8. A color cathode ray tube according to claim 4, wherein said at least one intermediate electrode is supplied with a voltage obtained by dividing said highest voltage with an internal resistor incorporated within said cathode ray tube.

* * * * *